US007513413B2

(12) United States Patent
Graef et al.

(10) Patent No.: US 7,513,413 B2
(45) **Date of Patent: *Apr. 7, 2009**

(54) CORRELATION OF SUSPECT CURRENCY NOTE RECEIVED BY ATM TO THE NOTE DEPOSITOR

(75) Inventors: H. Thomas Graef, Bolivar, OH (US); Edward L. Laskowski, Seven Hills, OH (US); William D. Beskitt, Canton, OH (US); Michael Harty, North Canton, OH (US); Jeffrey Eastman, North Canton, OH (US); Richard J. Phelps, Stow, OH (US); Natarajan Ramachandran, Uniontown, OH (US)

(73) Assignee: Diebold, Incorporated, North Canton, OH (US)

( * ) Notice: Subject to any disclaimer, the term of this patent is extended or adjusted under 35 U.S.C. 154(b) by 1109 days.

This patent is subject to a terminal disclaimer.

(21) Appl. No.: 10/852,795

(22) Filed: May 25, 2004

(65) Prior Publication Data

US 2004/0232217 A1 Nov. 25, 2004

Related U.S. Application Data

(60) Continuation-in-part of application No. 10/426,068, filed on Apr. 29, 2003, now Pat. No. 6,774,986, and a continuation-in-part of application No. 09/992,357, filed on Nov. 13, 2001, now Pat. No. 6,783,061, said application No. 09/992,357 is a continuation-in-part of application No. 09/911,329, filed on Jul. 23, 2001, now Pat. No. 6,607,081, which is a continuation-in-part of application No. 08/980,467, filed on Nov. 28, 1997, now Pat. No. 6,273,413, said application No. 09/992,357 is a continuation-in-part of application No. 09/664,698, filed on Sep. 19, 2000, now Pat. No. 6,315,194, which is a continuation-in-part of application No. 09/390,929, filed on Sep. 7, 1999, now Pat. No. 6,331,000, said application No. 10/426,068 is a division of application No. 09/633,486, filed on Aug. 7, 2000, now Pat. No. 6,573,983, which is a continuation-in-part of application No. 09/135,384, filed on Aug. 17, 1998, now Pat. No. 6,101,266, which is a continuation-in-part of application No. 08/749,260, filed on Nov. 15, 1996, now Pat. No. 5,923,413.

(60) Provisional application No. 60/338,919, filed on Nov. 5, 2001, provisional application No. 60/155,281, filed on Sep. 21, 1999, provisional application No. 60/100,758, filed on Sep. 7, 1998.

(51) Int. Cl.
*G07F 19/00* (2006.01)

(52) U.S. Cl. ..... 235/379; 902/16

(58) Field of Classification Search ..... 235/379; 902/12–16

See application file for complete search history.

(56) References Cited

U.S. PATENT DOCUMENTS 4,472,627 A * 9/1984 Weinberger ..... 235/487
6,774,986 B2 * 8/2004 Laskowski ..... 356/71

* cited by examiner

*Primary Examiner*—Karl D. Frech
(74) *Attorney, Agent, or Firm*—Ralph E. Jocke; Daniel D. Wasil; Walker & Jocke

(57) ABSTRACT

The apparatus enables identifying data relating to a suspect currency note received by an ATM to be correlated with identifying data relating to the depositor of the suspect note. A note validator can assess the validity of received notes. Data can be generated that is usable to identify each suspect note and identify the person from whom the suspect note was received. The data usable to identify a suspect note can correspond to its serial number. The data usable to identify the person can correspond to an account number and/or a biometric input. The suspect note/depositor identifying data can be stored in correlated relation in a data store enabling each suspect note to be linked to a person. Thus, the validity of a received note can be determined, a suspect note can be identified, and correlating data usable to identify the suspect note depositor can be stored.

20 Claims, 23 Drawing Sheets

CORRELATION OF SUSPECT CURRENCY NOTE RECEIVED BY ATM TO THE NOTE DEPOSITOR

CROSS REFERENCE TO RELATED APPLICATIONS

This Application is a Continuation-In-Part of U.S. application Ser. No. 09/992,357 filed Nov. 13, 2001 now U.S. Pat. No. 6,783,061 and a Continuation-In-Part of U.S. application Ser. No. 10/426,068 filed Apr. 29, 2003 now U.S. Pat. No. 6,774,986.

Said U.S. application Ser. No. 09/992,357 claims benefit of U.S. Provisional Application No. 60/338,919 filed on Nov. 5, 2001. Said U.S. application Ser. No. 09/992,357 was a Continuation-In-Part of U.S. application Ser. No. 09/911,329 filed Jul. 23, 2001, now U.S. Pat. No. 6,607,081, which was a Continuation-in-Part of U.S. application Ser. No. 08/980,467 filed Nov. 28, 1997, now U.S. Pat. No. 6,273,413. Said U.S. application Ser. No. 09/992,357 was also a Continuation-In-Part of U.S. application Ser. No. 09/390,929 filed Sep. 7, 1999, now U.S. Pat. No. 6,331,000, which claims benefit of U.S. Provisional Application No. 60/100,758 filed Sep. 7, 1998. Said U.S. application Ser. No. 09/992,357 was also a Continuation-In-Part of U.S. application Ser. No. 09/664,698 filed Sep. 19, 2000, now U.S. Pat. No. 6,315,194, which claims benefit of U.S. Provisional Application No. 60/155,281 filed Sep. 21, 1999.

Said U.S. application Ser. No. 10/426,068 was a divisional of U.S. application Ser. No. 09/633,486 filed Aug. 7, 2000, now U.S. Pat. No. 6,573,983, which was a continuation-in-part of U.S. application Ser. No. 09/135,384 filed Aug. 17, 1998, now U.S. Pat. No. 6,101,266, which was a continuation-in-part of U.S. application Ser. No. 08/749,260 filed Nov. 15, 1996, now U.S. Pat. No. 5,923,413.

The disclosures of all of the foregoing Applications are incorporated herein by reference as if fully rewritten herein.

TECHNICAL FIELD

This invention relates to automated transaction machines. More specifically, this invention relates to an automated transaction machine which can receive currency notes.

BACKGROUND ART

Automated transaction machines include automated banking machines. A common type of automated banking machine is an automated teller machine ("ATM"). ATMs may be used by individuals to perform transactions such as dispensing cash, accepting deposits, making account balance inquiries, paying bills, and transferring funds between accounts. ATMs and other types of automated banking machines may be used to dispense media, sheets, or documents such as currency bills, tickets, scrip, vouchers, bank checks, gaming materials, stamps, coupons, receipts, account statements, or other media. Certain ATMs also enable customers to deposit checks, money orders, travelers checks, or other instruments. While many types of automated banking machines, including ATMs, are operated by consumers, other types of automated banking machines may be operated by service providers. Such automated banking machines may be used by service providers to provide cash or other types of sheets or documents when performing transactions. For purposes of this disclosure, an automated banking machine shall be construed as any machine that is capable of carrying out transactions which include transfers of value.

A popular brand of automated banking machine is manufactured by Diebold, Incorporated. Such automated banking machines are capable of receiving therein a banking card from a user of the machine. The card can have user information embedded in a magnetic stripe on the card. A machine card reader is capable of reading the magnetic stripe. The information may correspond to a user's personal identification number (PIN). The user can also enter the PIN through use of a machine keypad. The machine can determine whether the keypad-entered PIN matches the card-entered PIN. Upon determination of a match, the user can be authorized to carry out one or more transactions with the machine. Such a transaction may include dispensing currency notes to the machine user.

Automated banking machines currently in use often have a location on the machine where sheets can be received from a customer. For example, most machines include an area for receiving deposits. A deposit can include currency notes, including suspect notes.

DISCLOSURE OF INVENTION

Thus, there exists a need for an automated banking machine that can determine suspect currency notes.

The disclosures of all of the foregoing Applications are incorporated herein by reference as if fully rewritten herein.

It is an object of an exemplary form of the present invention to provide an automated banking machine.

It is a further object of an exemplary form of the present invention to provide an automated banking machine arrangement that can determine suspect currency notes.

It is a further object of an exemplary form of the present invention to provide an automated banking machine arrangement with the ability to determine the source or depositor of a suspect note.

It is a further object of an exemplary form of the present invention to provide an automated banking machine arrangement that can correlate suspect currency note data with data corresponding to a person.

It is a further object of an exemplary form of the present invention to provide an automated banking machine arrangement with a data store, where the arrangement has the ability to produce data usable to uniquely identify at least one suspect currency note and a person associated with the at least one suspect currency note, and where the arrangement further has the ability to store the produced data in the data store.

It is a further object of an exemplary form of the present invention to provide an automated banking machine arrangement that can correlate a suspect currency note with the depositor of the suspect note.

It is a further object of an exemplary form of the present invention to provide an automated banking machine arrangement that can store in a data store data correlating a suspect currency note with a person.

It is a further object of an exemplary form of the present invention to provide an automated banking machine arrangement that can store in a data store data correlating a suspect currency note with the depositor of the suspect note.

It is a further object of an exemplary form of the present invention to provide a method of determining whether a note received in an automated banking machine is a suspect note.

It is a further object of an exemplary form of the present invention to provide a method for operation of an automated banking machine arrangement in which data correlating a suspect currency note with the depositor of the suspect note is stored in a data store.

It is a further object of an exemplary form of the present invention to provide an automated banking machine which has a simpler customer interface.

It is a further object of an exemplary form of the present invention to provide an automated banking machine which has a single opening for receiving and providing various types of sheets and documents.

It is a further object of an exemplary form of the present invention to provide an automated banking machine which performs a plurality of banking transaction functions and which has a compact physical size.

It is a further object of an exemplary form of the present invention to provide an automated banking machine that may be more readily configured to provide different banking functions.

It is a further object of an exemplary form of the present invention to provide an automated banking machine that is economical to manufacture and operate.

It is a further object of an exemplary form of the present invention to provide an automated banking machine that accepts and delivers various types of banking documents in a stack from and to customers, respectively.

It is a further object of an exemplary form of the present invention to provide an automated banking machine that enables selectively separating sheets from a stack and processing such sheets in different ways depending upon the type of sheet.

It is a further object of an exemplary form of the present invention to provide an automated banking machine that enables selectively assembling document sheets into a stack.

It is a further object of an exemplary form of the present invention to provide a method for operation of an automated banking machine in which sheets are selectively removed from a stack by transporting the stack in a first transport path through an intersection with a second transport path, in which a sheet directing apparatus adjacent to the intersection selectively separates sheets from the stack.

It is a further object of an exemplary form of the present invention to provide a method for operation of an automated banking machine in which a sheet moving in a first transport path and a sheet moving in a second transport path are brought together in aligned relation to form a stack, as the sheets pass through an intersection of the first and second transport paths.

Further objects of exemplary forms of the present invention will remain apparent in the following Best Mode for Carrying Out Invention and the appended claims.

The foregoing objects are accomplished in an exemplary form of the present invention by an automated banking machine having a transport which moves sheets or stacks of sheets along a first transport path. The first transport path extends from a user accessible opening on an interface of the machine. The machine also includes an internal second transport path for transporting sheets. The second transport path meets the first transport path at an intersection. A sheet directing apparatus is positioned adjacent to the intersection. The machine further includes at least one sheet dispensing device and at least one sheet accepting device for dispensing and receiving sheets, respectively. The sheet dispensing and receiving devices are in operative connection with either the first or second transport paths.

In operation of the machine a stack of sheets which may include various types of documents is received from a user is moved from the opening along the first transport path. As the stack passes the intersection the sheet directing apparatus is selectively operative to separate a sheet from the stack and direct the sheet into the second transport path. Once in the second transport path the separated sheet may be handled individually for processing or storage in the machine. Passing the stack through the intersection enables selectively removing sheets from the stack in response to operation of the sheet directing apparatus.

Sheets dispensed or otherwise held in the machine are enabled to be assembled into a stack by moving a sheet in the first transport path. A sheet in the second transport path is moved to the intersection in coordinated relation with the first sheet. The first and second sheets engage in aligned relation and form a stack in the first transport path as the sheets move through the intersection. Additional sheets are selectively added to the stack as the stack is thereafter again moved through the intersection while successive sheets are brought to the intersection through the second transport path. Various types of sheets are selectively assembled into the stack in the operation of the machine. Control circuitry, which can include one or more computers and associated software, operates the components of the machine to assemble the stack. Once the stack is assembled, it is delivered to the user by passing it along the first transport path to the user opening.

In exemplary embodiments, data may be acquired and stored which is usable to determine the individual users who have provided and/or received particular sheets to/from the machine. This can enable the machine to determine the source or disposition of suspect notes for example. Alternatively or in addition, exemplary embodiments may limit the dispense of documents such as checks, money orders, or cash from the machine to particular individuals to reduce the risk of money laundering or other illegal or fraudulent activity. Other exemplary embodiments may include other or additional features.

BEST MODE FOR CARRYING OUT INVENTION

Figure 1:
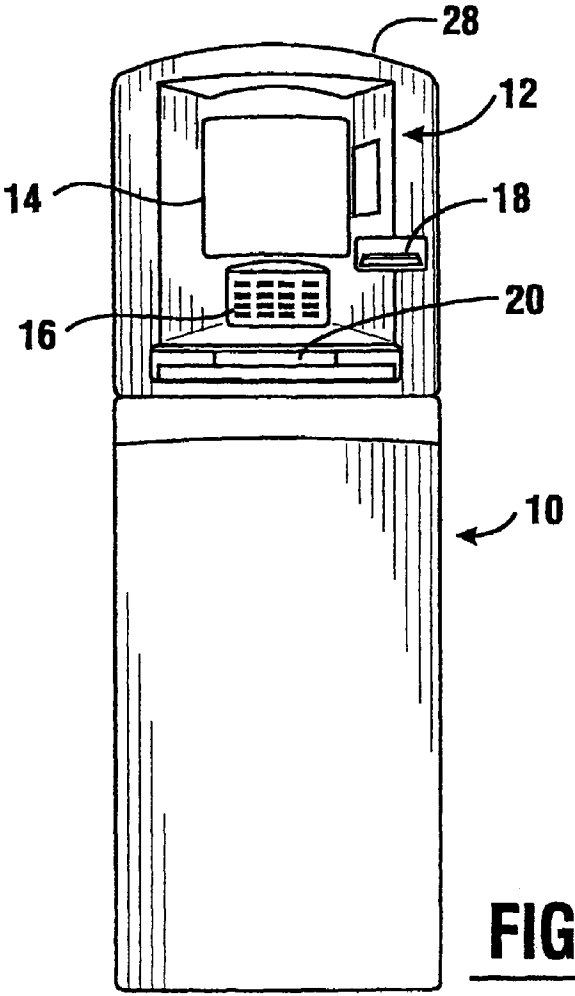
FIG. 1 is a front plan view of an exemplary automated banking machine including some features of the present invention.

Referring now to the drawings, and particularly to FIG. 1, there is shown therein an automated banking machine generally indicated 10. Machine 10 is an ATM. However, other embodiments of the invention may be other types of automated banking machines. ATM 10 includes a user or customer interface generally indicated 12. Customer interface 12 includes a touch screen 14. Touch screen 14 is of a type known in the prior art which serves as both an input device and an output device. The touch screen enables outputs through displays on the screen and enables customers to provide inputs by placing a finger adjacent to areas of the screen.

Customer interface 12 further includes a keypad 16. Keypad 16 includes a plurality of buttons which may be actuated by a customer to provide inputs to the machine. Customer interface 12 further includes a card reader slot 18. Card slot 18 is used to input a card with encoded data thereon that is usable to identify the customer and/or the customer's account information. Card slot 18 is connected to a card reader of a conventional type for reading data encoded on the card. Other exemplary embodiments may include types of input devices other than a card reader and/or a keypad. Some embodiments may include input devices such as biometric readers that may be operative to receive customer identifying inputs such as fingerprints, iris scans, retina scans, face topography data, voice data or other inputs that provide data that is usable to identify a user. An example of an ATM that uses biometric input devices and other types of input devices is shown in U.S. Pat. No. 6,023,688 the disclosure of which is incorporated herein by reference.

Customer interface 12 further includes an opening 20. Opening 20 as later explained, is used to receive stacks of sheets or documents from a customer operating the machine 10. Opening 20 is also used to deliver stacks of documents to customers operating the machine. Although opening 20 is shown exposed in FIG. 1, it should be understood that in other embodiments it may be selectively covered by a movable gate or similar closure structure. It should be understood that these features of the described ATM user interface are exemplary and in other embodiments the user interface may include different components and/or features.

Figure 2:
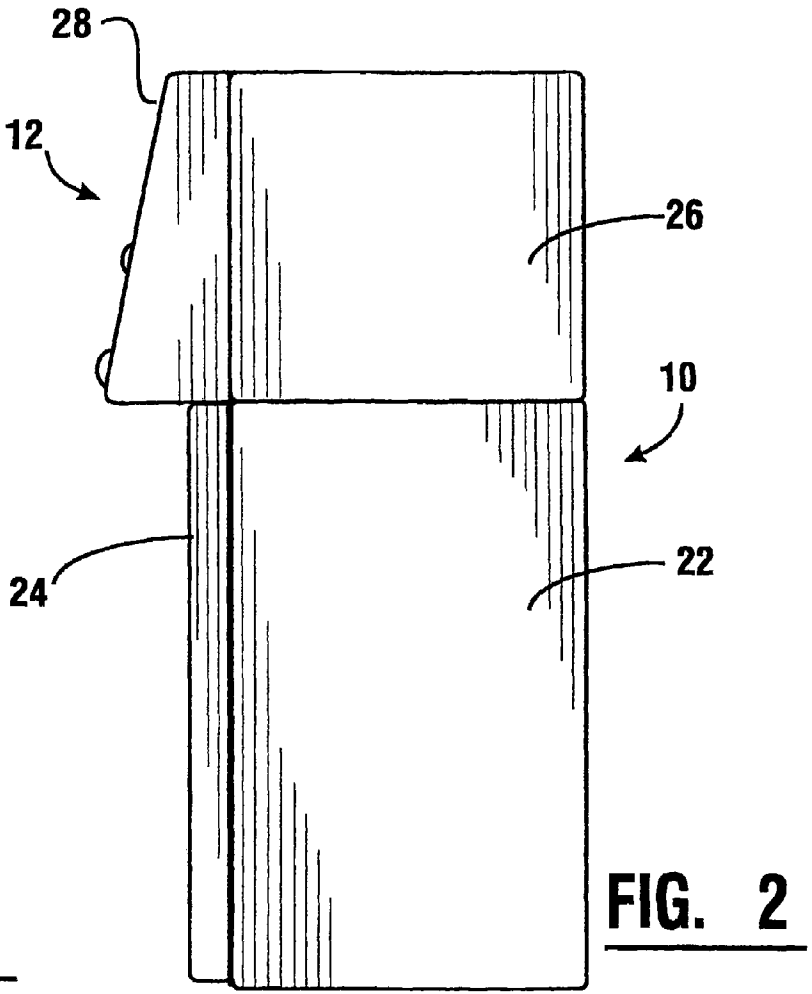
FIG. 2 is a left side view of the automated banking machine shown in FIG. 1.

As shown in FIG. 2 machine 10 has a generally divided body structure which includes a chest portion 22. Chest portion 22 in the exemplary embodiment is preferably a secure chest and is used for holding items of value such as currency or deposits. Chest portion 22 has a door 24 which can be selectively opened to gain access to the interior of the chest portion. Door 24 preferably includes a combination lock or other locking mechanism which prevents the chest portion from being opened by unauthorized persons.

Machine 10 further includes an upper enclosure portion 26. The upper enclosure portion has components of the customer interface 12 thereon. The customer interface portion 12 includes a fascia 28. Fascia 28 is preferably movably mounted on the upper enclosure portion 26 and may be selectively opened to gain access to components housed in the upper enclosure portion. A locking mechanism is preferably included in the upper enclosure portion of the exemplary embodiment for preventing unauthorized persons from gaining access to the interior thereof.

Figure 3:
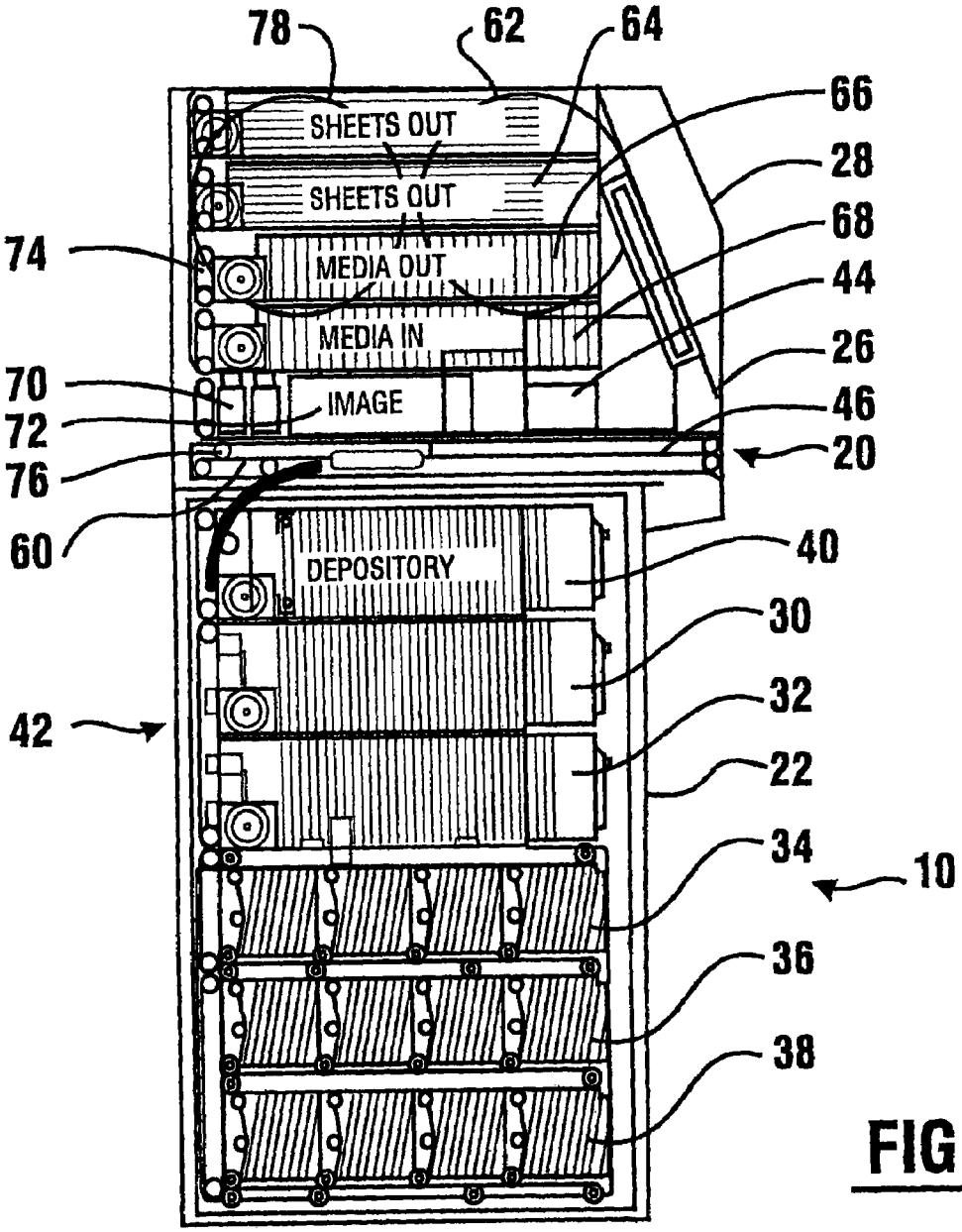
FIG. 3 is a schematic cross sectional view of the automated banking machine shown in FIG. 1.

As shown in FIG. 3 machine 10 includes a plurality of devices for carrying out banking transactions. It should be understood that the devices discussed hereafter are exemplary and that additional or different devices may be included in other embodiments of the invention.

The interior of ATM 10 is schematically shown in FIG. 3. The exemplary ATM includes devices for handling sheets such as notes and other documents. ATM 10 includes sheet dispensing devices, document producing devices and sheet receiving devices. Among the sheet dispensing devices are currency dispensers 30 and 32. Currency dispensers 30 and 32 may be of the type shown in U.S. Pat. No. 4,494,747, the disclosure of which is incorporated herein by reference, which selectively dispense sheets one at a time in response to control signals. Currency dispensers 30 and 32 may include removable sheet holding containers or canisters which include indicia thereon. The canisters may be interchangeable and of the type shown in U.S. Pat. No. 4,871,085, the disclosure of which is incorporated herein by reference. The indicia on the sheet holding canisters may be indicative of the type and/or properties of sheets held therein (i.e., currency type and denomination) and the indicia is read by a reading apparatus when the canister is installed in the machine.

The exemplary ATM may operate in response to the indicia on the canisters to adjust the operation of the dispensers to conform to the canister contents and position. In the exemplary embodiment the sheet holding canisters and other devices, may include indicia of the type shown in U.S. Pat. No. 4,871,085. The information represented by the indicia is read by the reading apparatus and the resulting signals transmitted to the machine control circuitry. The control circuitry adjusts operation of the sheet dispensing and receiving devices in response to the signals to conform to the type and character of the sheets held in the various canisters.

In the exemplary embodiment of machine 10 shown in FIG. 3, the machine preferably includes a note handling mechanism including sheet receiving and delivering devices 34, 36 and 38. The exemplary sheet receiving and delivering devices may be of the type shown in U.S. Pat. No. 6,331,000, the disclosure of which is incorporated herein by reference. The sheet delivering and receiving devices may enable receiving and storing sheets in selected compartments as well as selectively delivering sheets from the various compartments. As can be appreciated from the incorporated disclosure, some of the note handling mechanisms may receive and store notes only, others may dispense notes only and some may both receive and dispense notes. Other mechanisms may process sheets of types other than notes. Machine 10 further includes an envelope depository schematically indicated 40. Depository 40 is a device configured to accept and hold relatively thick sheet-like deposit envelopes deposited by customers in the machine.

Depository 40, currency dispensers 30 and 32 and sheet receiving and delivering devices 34, 36 and 38 are all positioned within the chest portion 22 of the machine 10. In the exemplary embodiment, the sheet dispensing and receiving devices, except for the depository, in the exemplary embodiment may be interchangeably positioned in the machine. The control circuitry adjusts operation of the machine accordingly based on the device positions and the indicia on the canisters or devices.

Each of the currency dispensers 30 and 32, sheet receiving and delivering devices 34, 36 and 38, and the depository 40 are in communication with a sheet transport path generally indicated 42. Sheet transport path 42 comprises a plurality of sheet transports which are aligned and in operative connection through a rear area of the chest portion. Sheet transport path 42 may include one or more sheet transports of the type shown in U.S. Pat. No. 5,240,638, the disclosure of which is incorporated herein by reference. Each of the depository 40, currency dispensers 30 and 32 and sheet receiving and delivering devices 34, 36 and 38 are in operative connection with the sheet transport path 42, and are enabled to deliver sheets to and/or receive sheets from the sheet transport path 42.

Sheet transport path 42 can extend through an opening in the chest portion 22 of the ATM chest. Wiring that connects components located in the chest portion with components in the upper enclosure portion 26 also extends through an opening in the chest portion and is connected to control circuitry, schematically indicated 44. The control circuitry 44 preferably includes at least one processor or computer in operative connection with at least one memory or data store. A computer can use software to carry out machine operations. The control circuitry 44 is operative to carry out programmed instructions based on data stored in the memory. The control circuitry in the exemplary embodiment operates the machine to carry out the operations hereinafter described.

Upper enclosure portion 26 includes the fascia 28 and the customer accessible opening 20. A first transport path generally indicated 46 extends inside the machine from opening 20. First transport path 46 preferably includes an interwoven belt type transport of the type shown in U.S. Pat. No. 5,797,599, the disclosure of which is incorporated herein by reference. A transport of this type is schematically shown in FIG. 5 and is generally indicated 48.

Transport 48 includes a plurality of spaced first rolls 50 and a plurality of intermediate spaced second rolls 52. Rolls 50 and 52, which are preferably crowned rolls, support elastomeric belts thereon. First rolls 50 support first belts 54 and second rolls 52 support second belts 56. Belts 54 and 56 extend longitudinally in the transport 48.

Figure 5:
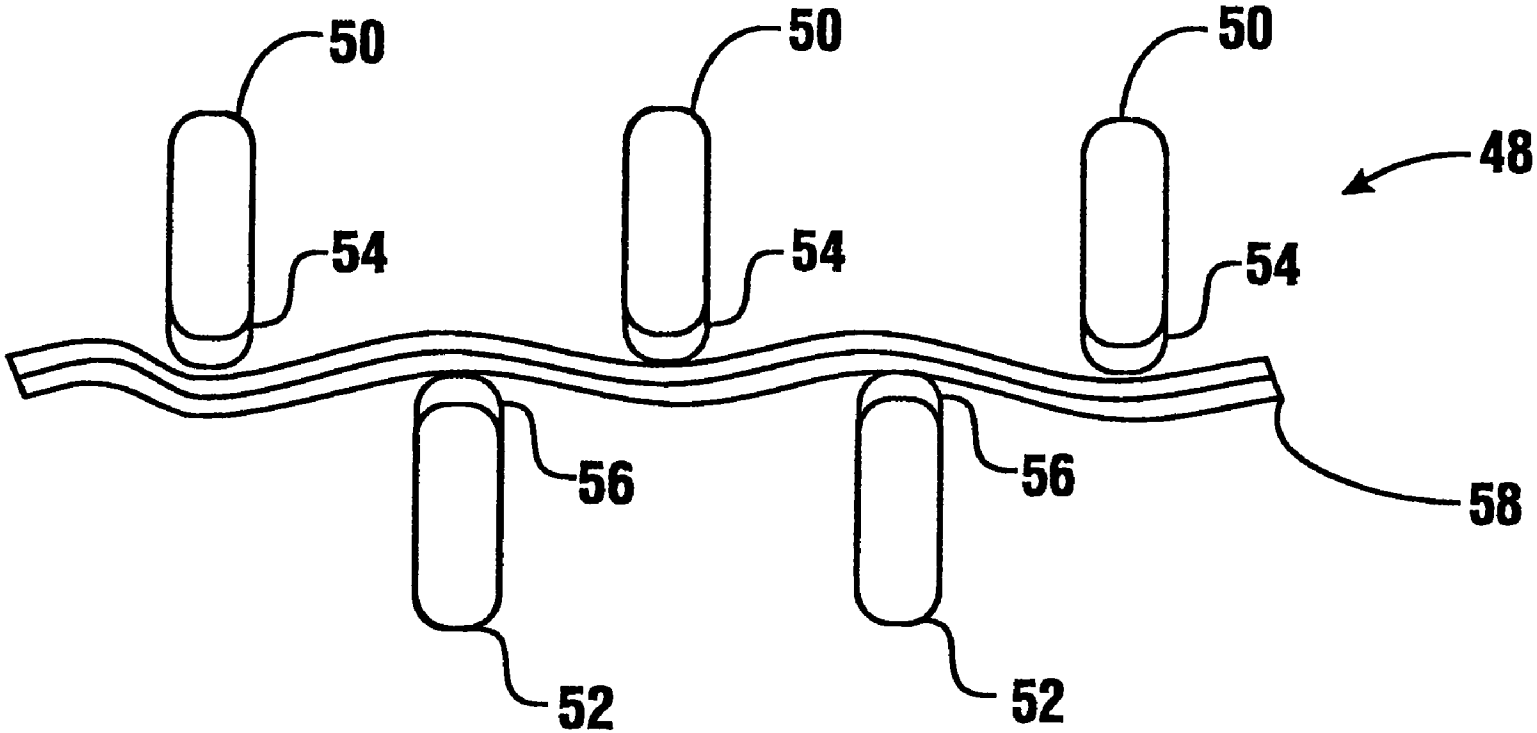
FIG. 5 is a transverse cross sectional view of a transport used in the automated banking machine.

A stack of sheets schematically represented by sheet 58 in FIG. 5, move in engaged relation with belts 54 and 56 in the transport as described in the incorporated patent disclosure. The configuration of transport 48 enables transporting stacks having varied numbers and types of sheets, as well as transporting passbooks and other forms of stacked sheets. The transport of the exemplary embodiment is useful because of its ability to transport sheets of various types, having varied thicknesses and frictional properties while minimizing skewing.

Referring again to FIG. 3, first transport path 46 intersects with transport path 42 at a first intersection, generally indicated 60. As hereinafter explained the exemplary embodiment comprises a separating mechanism that separates sheets individually from a stack and a stack assembly mechanism that produces a stack of documents. In the exemplary embodiment, sheets are selectively stacked and unstacked while moving through first intersection 60 to enable processing of sheets within the machine 10.

Upper enclosure portion 26 also includes various sheet producing, dispensing and/or receiving devices. These dispensing and receiving devices may include dispensers or devices for receiving or dispensing sheets similar to those shown in U.S. Pat. Nos. 4,494,747 or 6,331,000, and may include removable canisters for holding sheets therein. Such removable canisters may also include indicia of the type described in U.S. Pat. No. 4,871,085, which are read by apparatus within the machine. The control circuitry may be operative to control the operation of the machine in response to the indicia.

Devices 62 and 64 may serve as part of document producing device and may hold sheets such as blank receipt or statement forms. Alternatively, one of such canisters may hold blank instruments which must be completed, such as scrip forms, money orders, or travelers checks. A further sheet dispensing device 66 may dispense documents that need to be completed before documents are dispensed without further processing, such as plates of stamps.

A sheet receiving device 68 is also preferably included in the upper enclosure portion. Sheet receiving device 68 may be used for holding sheets such as checks or other instruments, which have been input by a customer to the machine and which have been imaged and/or canceled through processing in the machine.

The exemplary upper enclosure portion further includes at least one printing device schematically indicated 70. Printing device 70 may be used for selectively printing on sheets under control of the control circuitry. An imaging device schematically indicated 72 is also included. Imaging device 72 is preferably of the type which enables reading and generating an electronic image of a document, such as that shown in U.S. Pat. Nos. 5,534,682 or 5,923,413, the disclosures of each of which are incorporated herein by reference as if fully rewritten herein. In some embodiments an imaging device may operate in conjunction with the control circuitry to produce signals which comprise an electronic representation of an image of a check or other instrument. The electronic representation may include all or selected portions of one or both sides of the sheet. For example, in some situations it may be suitable to obtain an electronic image of alphabetic, numerical and/or other symbols or features on the check. For example, such data may be analyzed using character recognition software such as software commercially available from Check Solutions Inc. or other companies to determine the maker, amount and/or other data pertinent to the check for purposes of receiving and/or cashing the check.

In some embodiments printing devices or other devices may also serve as part of a cancellation device. Such a cancellation device may serve to print or otherwise mark checks or other documents received by the machine. For example, the machine may mark as cancelled checks which are received and processed by the ATM. In some embodiments such checks or documents may be marked through operation of the cancellation device and then stored in a check storage location in the machine. In other embodiments the cancellation device after the document has been imaged, may mark the document as cancelled and return the cancelled document to the user of the machine. In some embodiments one or more such cancelled documents may be assembled in a stack in a manner hereafter discussed, when returned to a user. Cancelled documents may also be returned in an assembled stack with other documents such as a receipt for the transaction and/or notes dispensed by the ATM as a result of cashing the check. The control circuitry may also operate to store data corresponding to the check and the identity of the user of the ATM providing the check to the machine in one or more data stores for purposes of record keeping. For example, the data store may store data corresponding to the check with the data that corresponds to a user's account number, biometric data, photograph or other data usable to identify a user. Of course these approaches are exemplary and other approaches may be used.

In some embodiments the control circuitry may operate to check the user identity data before cashing one or more checks. The control circuitry may also be programmed to limit the risk of check cashing by unauthorized persons and/or to reduce the risk of money laundering. For example, before cashing a check the control circuitry may operate to compare data corresponding to the characters identifying the payee indicated on the check to other input data corresponding to the user of the machine and/or to the characters on the check comprising the endorsement. If the payee, user and/or endorsement data does not correspond, the control circuitry may operate so that the check is not accepted or cashed. Further the control circuitry may operate to determine the amount and/or nature of checks the particular user has presented at the ATM and/or within a prior time period. The ATM may also operate to communicate with other computers in a network to determine the amount or nature of checks presented by the user at other ATMs. If the user's check presenting activities fall outside certain established programmed parameters, such that the user's activities may be indicative of theft of the check or money laundering, for example, the ATM may refuse the transaction.

In the alternative and/or in addition a user presenting a check may be required by the control circuitry to provide at least one biometric input. This may be done even in circumstances where the user may be identifiable by data on a card or another manner. The biometric identification data may be compared to stored data and used to evaluate the check cashing activities of this particular user. A determination may be made by the control circuitry or by a remote computer to determine if the activities fall outside the established parameters such that the current transaction is suspicious and not permitted. In this way a user with multiple cards and/or multiple identities may be prevented from conducting transactions that might be suspicious in terms of theft or money laundering. Of course some embodiments may also operate to cross check biometric data with data on a debit or credit card or other item or other device presented by the user to the ATM to provide greater assurance as to the identity of the user. Of course in other embodiments other approaches may be used.

The exemplary handling devices 62, 64 and 66, as well as the sheet receiving device 68, of the ATM are all in communication with one or more transports. These transports may be of the type shown in U.S. Pat. No. 5,342,165, the disclosure of which is incorporated herein by reference, or other suitable sheet transport devices. The sheet transport devices form a sheet transport path 74. Sheet transport path 74 extends to transport path 46 and meets transport path 46 at a second intersection 76.

The upper enclosure portion may also include additional or other devices. Such devices may include a journal printer as schematically indicated by rolls 78. The journal printer is used to make a paper record of transactions conducted at machine 10. Electronic journals may also be made by the control circuitry and stored in memory. Other devices which may be included in the machine are other types of document producing devices, audio output devices, customer sensors, cameras and recorders, biometric sensing devices and other apparatus suitable for use in the operation of the particular type of automated banking machine.

Figure 4:
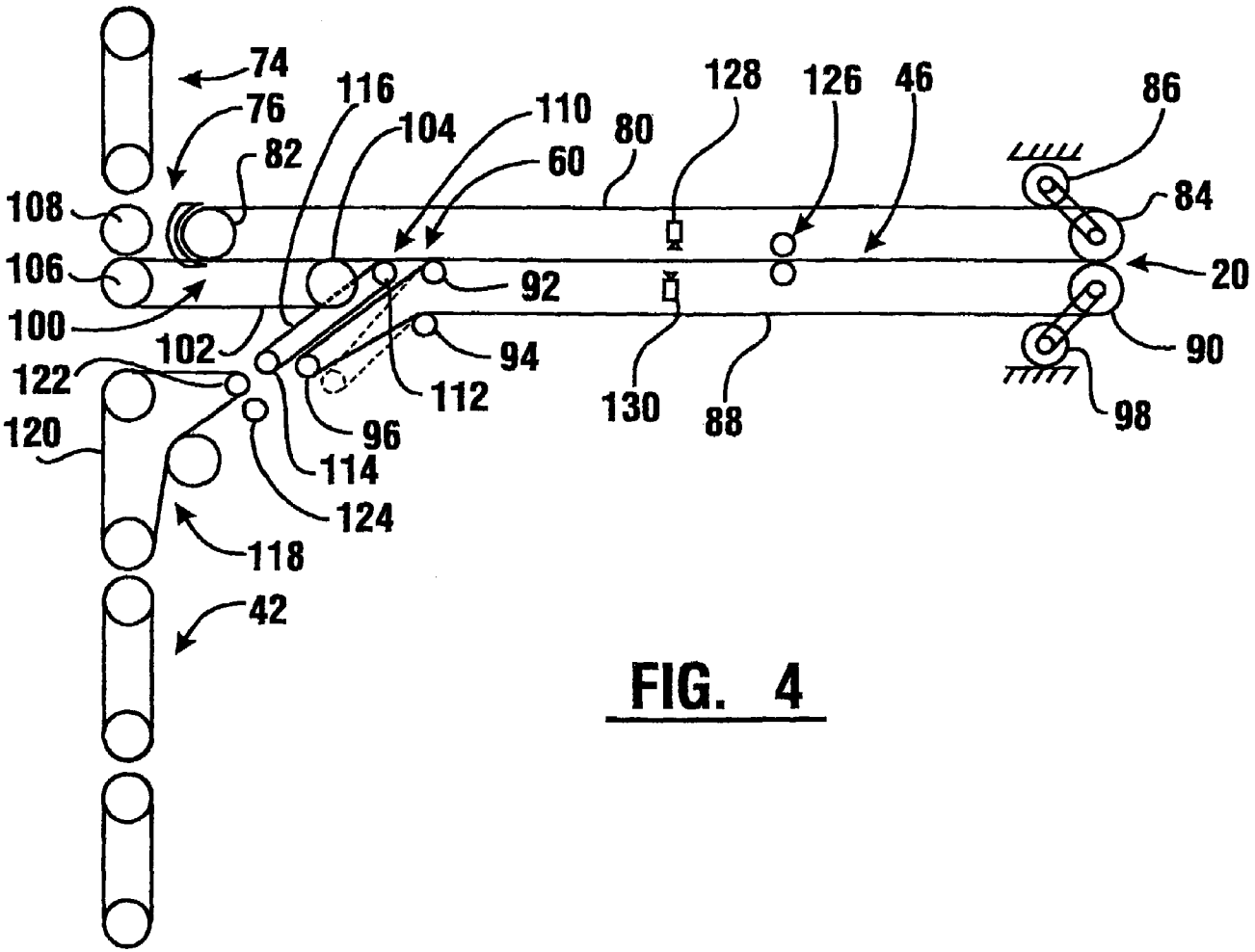
FIG. 4 is a side schematic view of a first transport path and a second transport path in the automated banking machine.

Transport paths 42, 46 and 74 of the exemplary machine are shown in greater detail in FIG. 4. Transport path 46, which includes one or more transports of the interwoven belt type shown in FIG. 5. The transport path has therein a plurality of first belts 80 which extend between first rolls 82 and 84. First rolls 82 and 84 are selectively driven by a reversible drive, schematically indicated 86.

Second belts 88 extend between a second roll 90 and rolls 92, 94 and 96. Second belts 88 are driven by a second reversible drive schematically indicated 98. As shown in FIG. 4, roll 96 is selectively movable for purposes which are later explained. Of course it should be understood that the belts and rolls shown in the first transport path 46 are actually a plurality of spaced belts and rolls of the type shown in FIG. 5.

First transport path 46 further includes a further transport section 100. Transport section 100 is similar to the transport shown in FIG. 5 and includes a plurality of third belts 102 journaled on spaced rolls 104 and 106.

Rolls 106 have positioned adjacent thereto a plurality of holding rolls 108. Rolls 108 are positioned in spaced axial intermediate relation of third belts 102. This configuration imparts a wave configuration to sheets and stacks of sheets in a manner comparable to that imparted to sheets held by transport 48 as shown in FIG. 5. Holding rolls 108 and transport section 100 can be independently driven by reversible drives under the control of the control circuitry 44.

Adjacent to first intersection 60, where sheet path 42 meets sheet path 46, is a sheet directing apparatus generally indicated 110. Sheet directing apparatus 110 includes sheet engaging rolls 112 and further rolls 114. Rolls 112 and 114 have resilient belts 116 mounted thereon. It should be understood that rolls 112 and 114 can be driven by one or more independent reversible drives under control of the control circuitry 44. It should be understood that rolls 112 and 114 and belts 116 in FIG. 4, represent a plurality of such belts and rolls which are preferably disposed in intermediate relation between the lower flights of first belts 80.

Transport path 42 further includes transport 118 which is adjacent to depository 40. Transport 118 includes a plurality of rolls which can drive belts 120 in response to a reversing drive. Rolls 122 which are engaged with belts 120, as well as rolls 124 which can be independently driven by one or more reversible drives, are positioned in the sheet path 42 adjacent to rolls 114 and 96. The purpose of this configuration is later discussed in detail.

As schematically represented in FIG. 4 transport path 46 includes sensing devices. These sensing devices are in operative connection with the control circuitry 44, and operate to sense features of sheets and stacks of sheets in the sheet transport path. A thickness sensor schematically indicated 126 is preferably provided for sensing the thickness of sheets, stacks of sheets, or sheet like deposit envelopes that move along transport path 46. Indicia reading devices 128 and 130 are preferably operative to sense indicia on sheets and envelopes moving in the transport path. The sensing devices may include photo reflective devices, magnetic sensing devices or other appropriate devices for distinguishing currency, various types of negotiable instruments and deposit envelopes. For example, in some embodiments the sensing devices in combination with the control circuitry in the machine may comprise a validating device for assessing the validity of notes or other documents. An example of such a validating device is shown in U.S. Pat. No. 5,923,413, the disclosure of which is incorporated herein by reference. In some embodiments the validating device may additionally or alternatively be operative to identify individual notes. An example of an arrangement that may be used in an automated banking machine to determine the identity and validity of particular currency notes may be found in U.S. application Ser. No. 10/426,068, the disclosure of which is incorporated herein by reference as if fully rewritten herein. A validating device may produce through algorithms one or more distinctive values that are generally uniquely associated with a particular note. In addition or in the alternative, the validating device may include character recognition capabilities which enable determination of the serial numbers or other unique characters associated with particular notes. This can enable some embodiments of the machine to store in correlated relation, in at least one data store, data that uniquely identifies a note input to the ATM and the particular user who provided the note to the machine. This may enable the ATM to identify a particular suspect note and capture the information on the user who provided it to the machine. The particular type, position and capabilities of sensing devices and/or validating devices used in a particular machine will depend on the characteristics and types of documents which are intended to be processed by the machine. It should be understood that more than one validation device can be used.

Various sheet manipulating and processing operations performed by the exemplary automated banking machine of the described embodiment are now explained in detail with reference to FIGS. 6-21.

Figure 6:
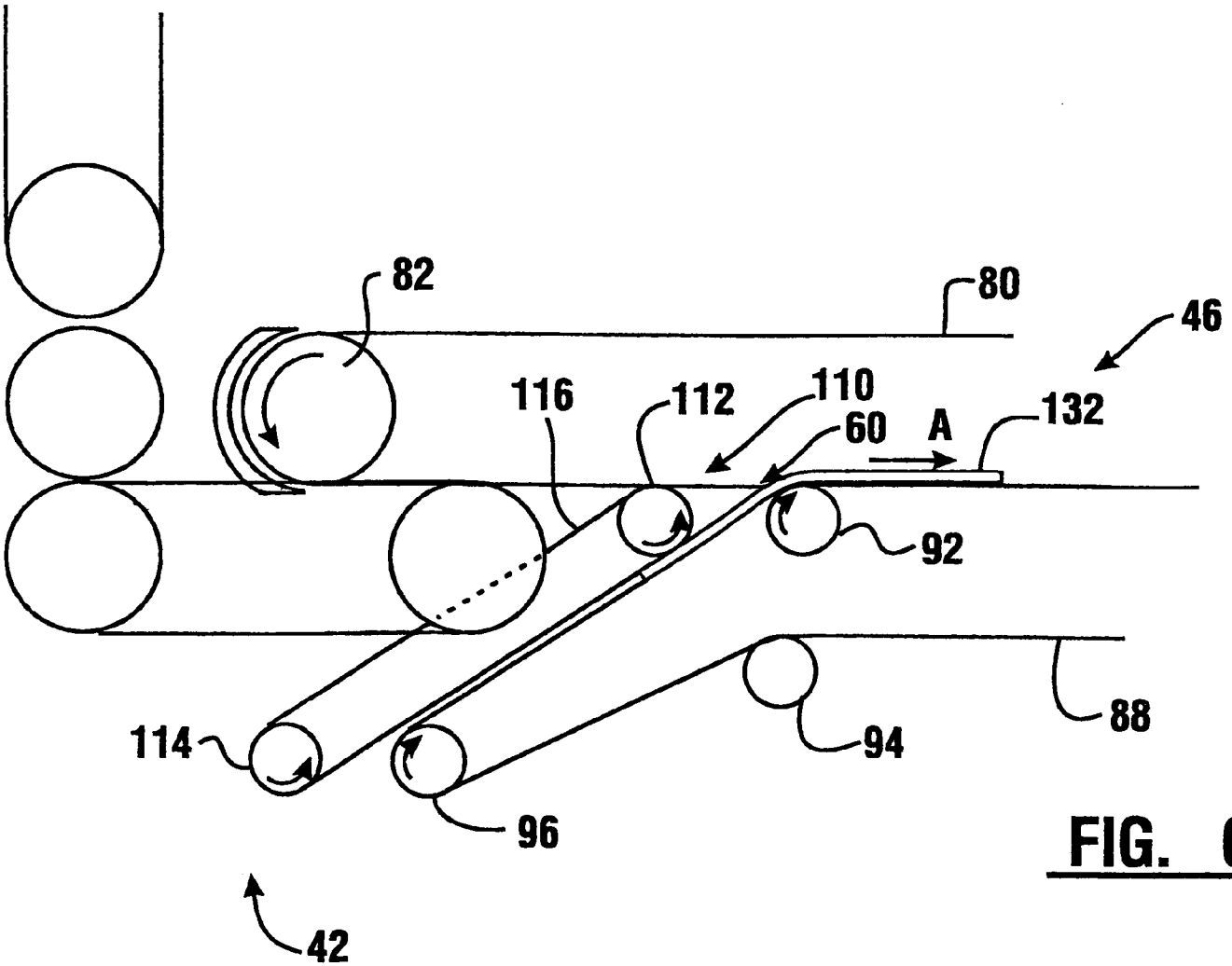
FIG. 6 is a schematic side view of a sheet moving from the second transport path to the first transport path through an intersection.

FIG. 6 shows a sheet 132 moving through the intersection 60 of the first sheet path 46 and sheet path 42. Sheet 132, prior to reaching the position shown in FIG. 6, may have been dispensed by one of the sheet dispensing devices positioned adjacent to transport path 42 and moved adjacent to the intersection by the transports which make up the transport path. As sheet 132 approaches the intersection it is engaged by belts 116 of the sheet directing apparatus 110, as well as belts 88. The control circuitry operates the drives which move the belts to work in cooperating relation to move the sheet toward the intersection. Once the sheet is passed through the intersection it is engaged between the lower flights of belt 80 and the upper flights of belts 88, and the sheet 132 is carried in the first direction indicated by Arrow A in FIG. 6. As will be appreciated from FIG. 4, Arrow A is in the direction of the customer opening 20 of the automated banking machine.

Figure 7:
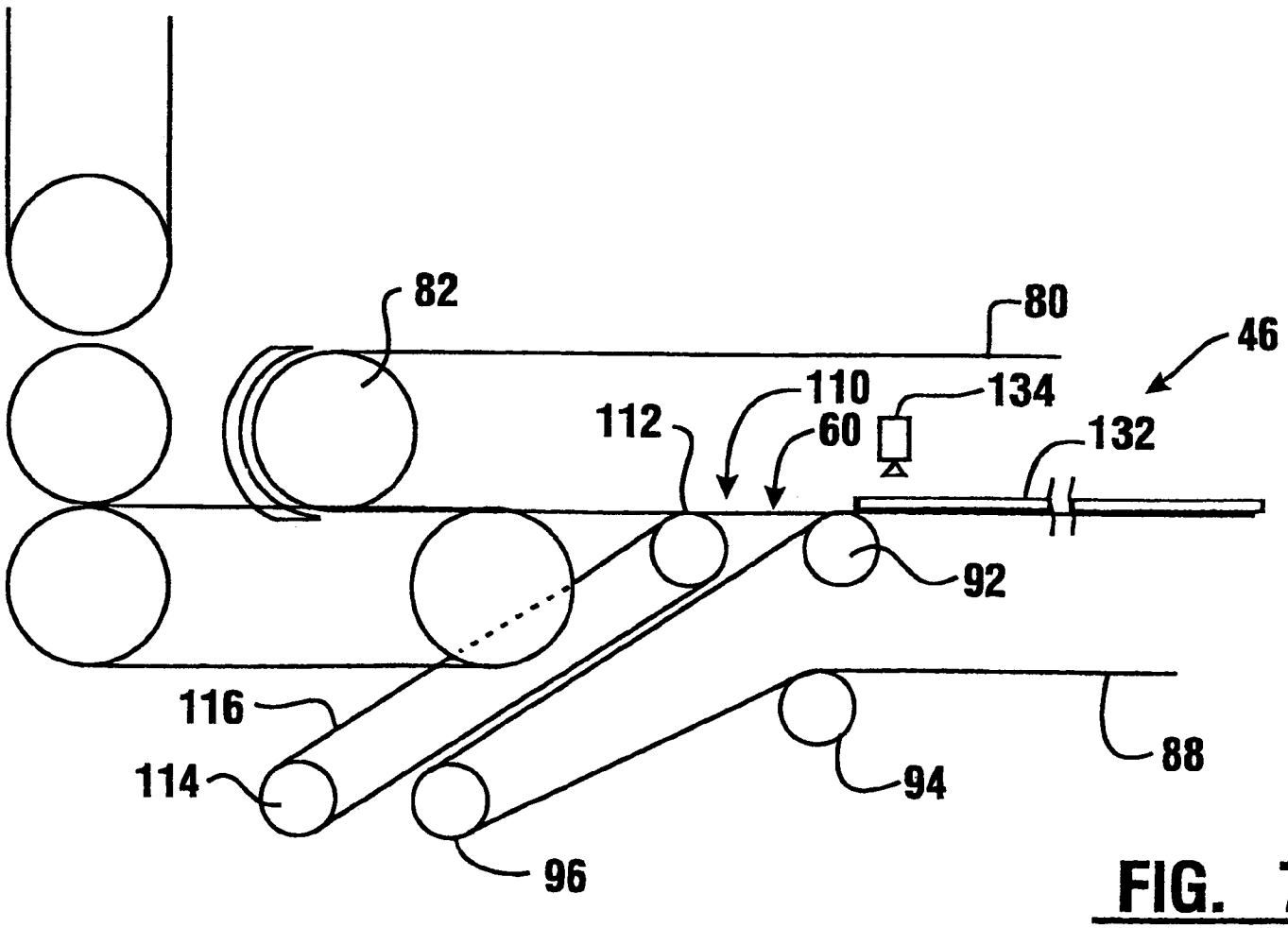
FIG. 7 is a view similar to FIG. 6 with the sheet moved into the first transport path from the intersection.

As shown in FIG. 7 in the mode of operation currently being described, the structures act as a stack assembly mechanism. Once sheet 132 is fully moved through the intersection in the first transport path 146, movement of the sheet in the first direction is stopped. This is accomplished by the control circuitry 44 operating the transport drives in accordance with its program logic stored in memory, and in response to customer inputs at the customer interface. A sensor schematically indicated 134 positioned in the first sheet path senses the position of the sheet. Sensor 134 is in operative connection with the control circuitry. Sensor 134 may be one of several types of sensors suitable for sensing the position of sheets, such as a photo reflective type sensor. Once sheet 132 is in the position shown in FIG. 7, belts 80 and 88 are stopped.

Figure 8:
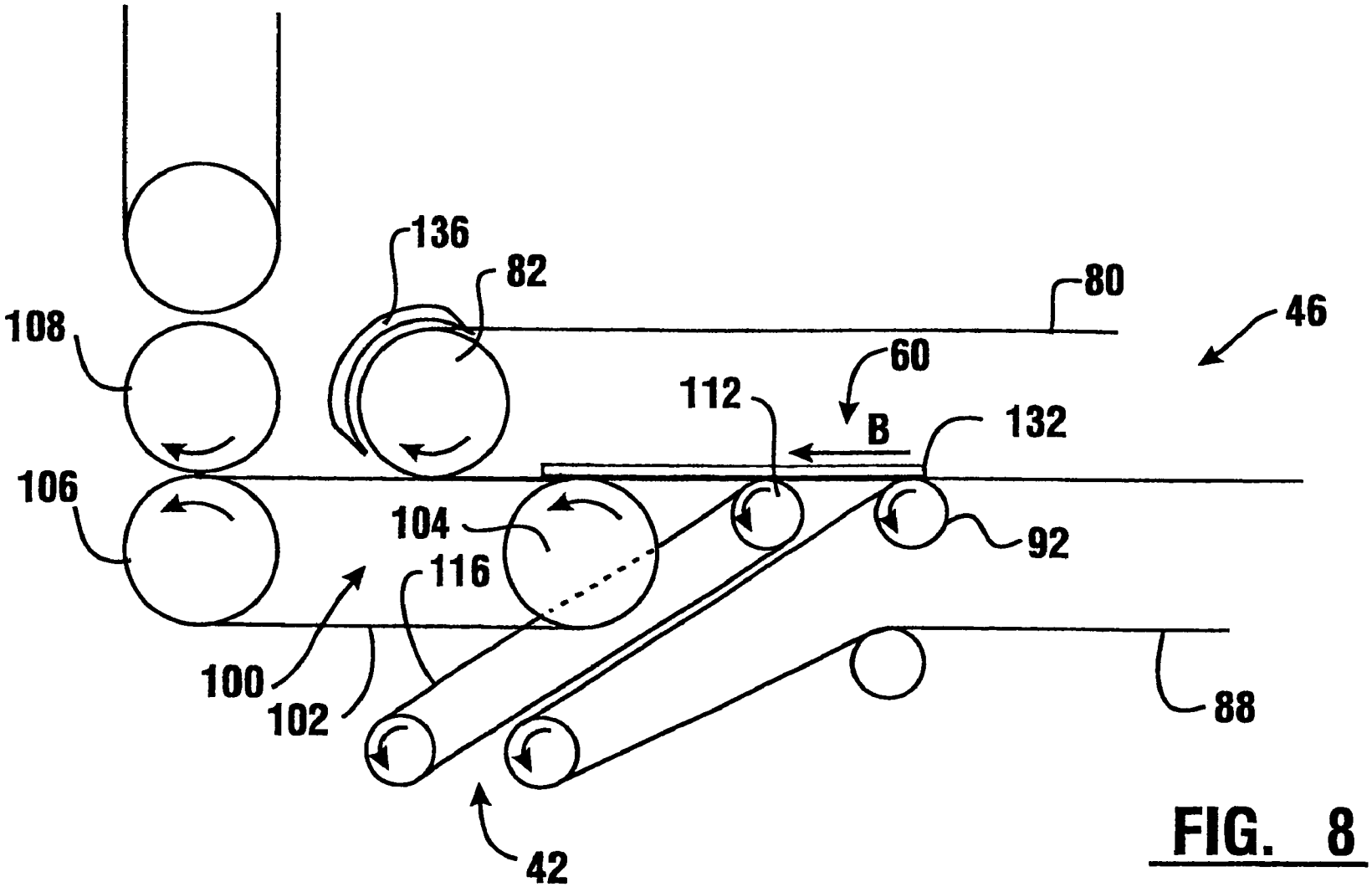
FIG. 8 is a schematic view similar to FIG. 7 with the sheet moving in an opposed direction through the intersection.

As shown in FIG. 8, the control circuitry now operates the components of the machine to move sheet 132 in a second opposed direction as indicated by Arrow B. To move sheet 132 through the intersection in the opposed direction, sheet engaging rolls 112 and belts 116 rotate to prevent sheet 132 from passing into the second sheet transport path 42. Transport section 100 is also operated by the control circuitry to engage sheet 132 and move it in the opposed direction. A sheet turnover member 136 later described in detail, is moved to enable sheet 132 to pass roll 82 in the first sheet path.

Figure 9:
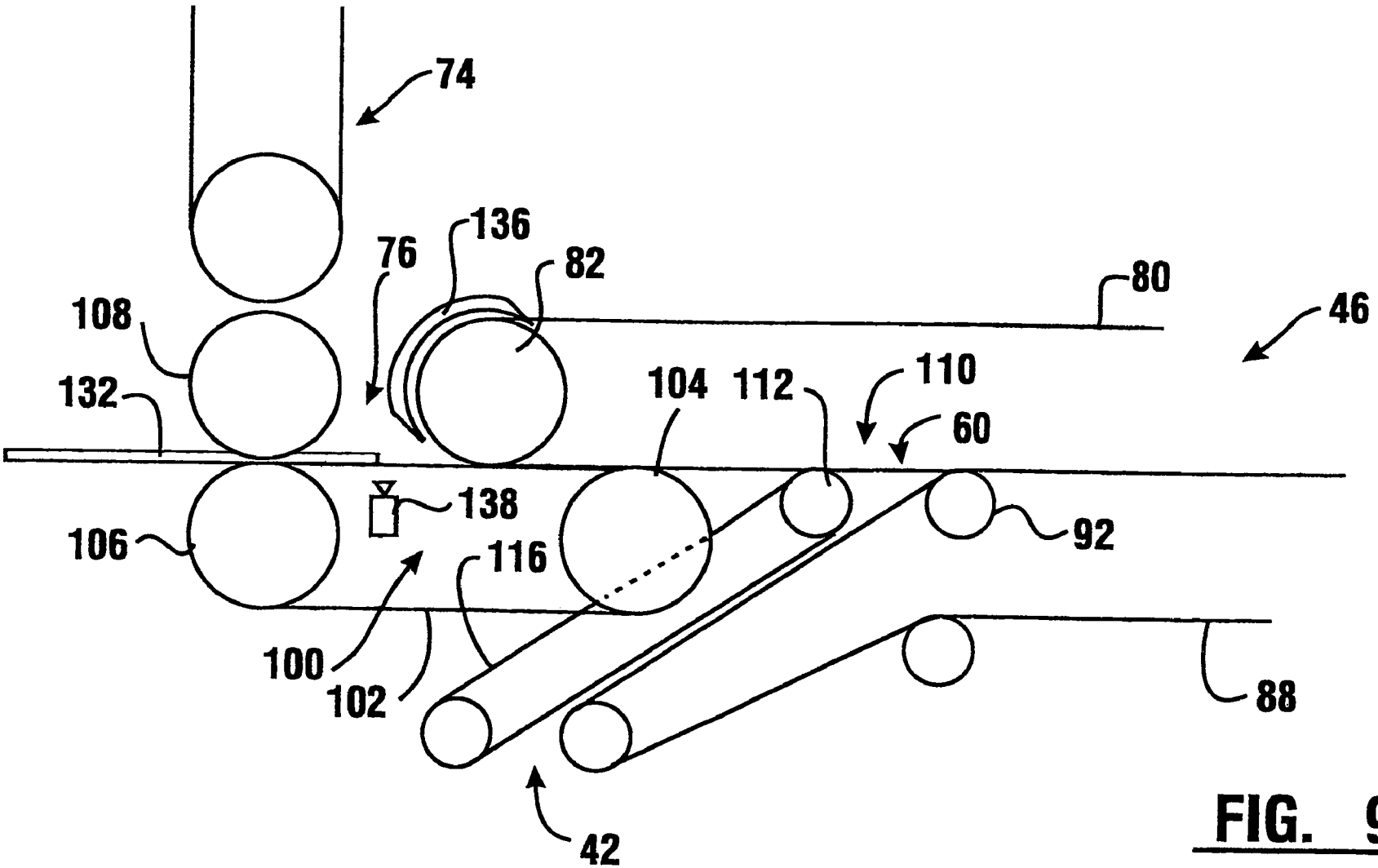
FIG. 9 is a schematic view similar to FIG. 8 with the sheet held in a holding device.

As shown in FIG. 9 sheet 132 is moved in the second direction until it is engaged between holding rolls 108 and transport section 100. A sensor which is schematically indicated 138 is positioned to sense that sheet 132 is positioned in the holding device provided by the combination of holding rolls 108 and transport section 100. Sensor 138 is operatively connected to the control circuitry which operates to stop further movement of sheet 132 in the second direction when it has reached the position shown. It should be noted that sheet 132 in this position is held adjacent to second intersection 76, which is the intersection of sheet path 74 and sheet path 46.

Figure 10:
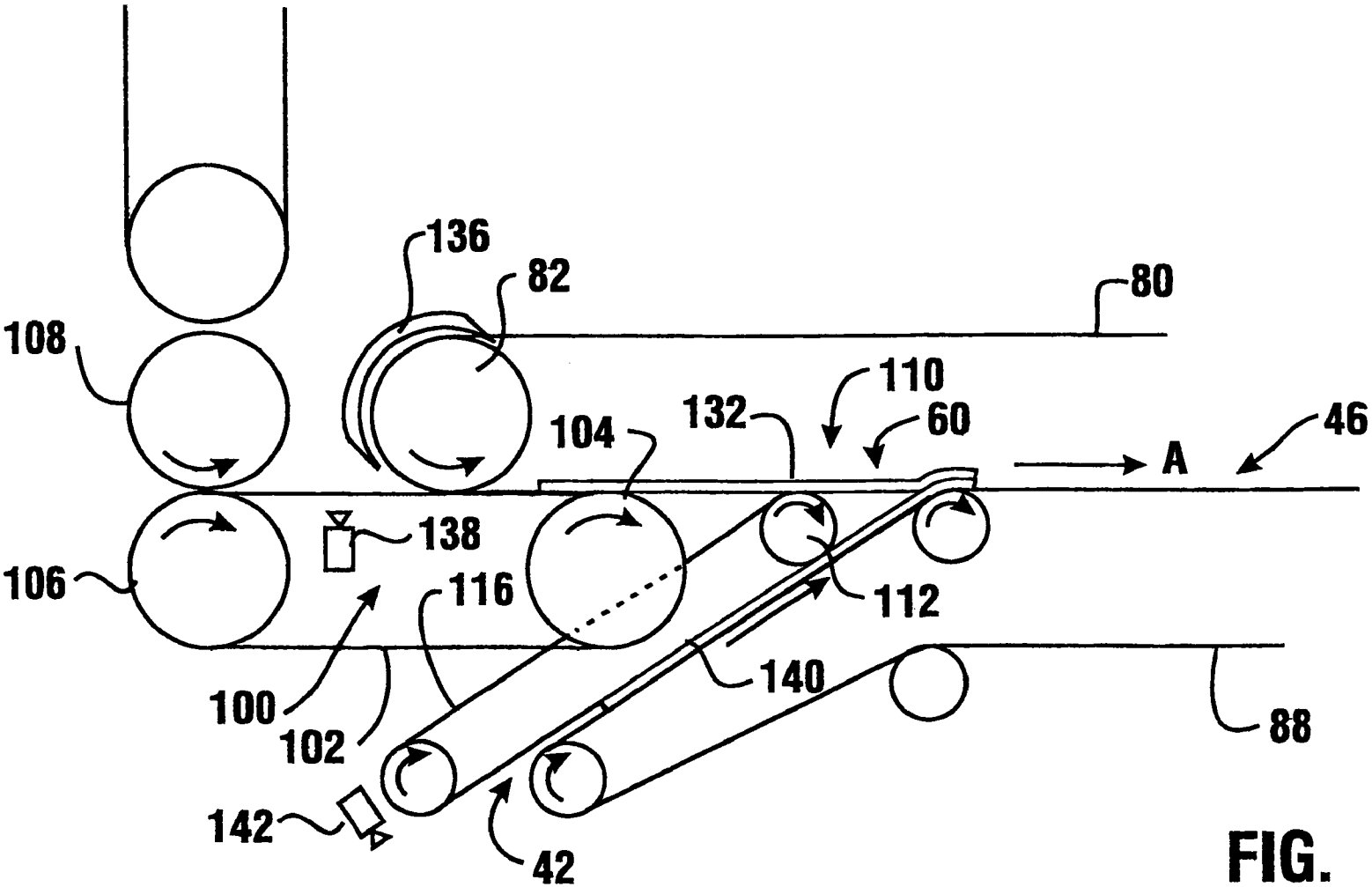
FIG. 10 is a view similar to FIG. 9 with the sheet moving in the intersection and engaging a second sheet being delivered through the second transport path, the second sheet engaging in aligned relation with the first sheet to form a stack.

The next step in the operation of the exemplary stack assembly mechanism is represented in FIG. 10. A further sheet 140 is moved in transport path 42 toward the intersection 60. Sheet 140 may be dispensed by one of the sheet dispensing devices, sheet producing devices or is otherwise in the path, and is moved toward the intersection. As sheet 140 moves adjacent to the intersection it is engaged by the belts 116 of sheet directing apparatus 110 as well as belts 88. Sheet 140 is also sensed by a sensor 142 in transport path 42. Sensor 142 is in operative connection with the control circuitry. The control circuitry operates to accurately coordinate the movement of the sheet 140 in engagement with the sheet directing apparatus 110 and belts 88.

As sheet 140 moves toward the intersection 60 the control circuitry operates to begin moving sheet 132 in the first direction along path 46 toward the intersection. The control circuitry coordinates the operation of the drives for the various components so that sheet 140 and sheet 132 pass through the intersection 60 in coordinated relation. As a result, sheets 132 and 140 engage in aligned, abutting relation so as to form a stack as they move through the intersection 60.

Figure 11:
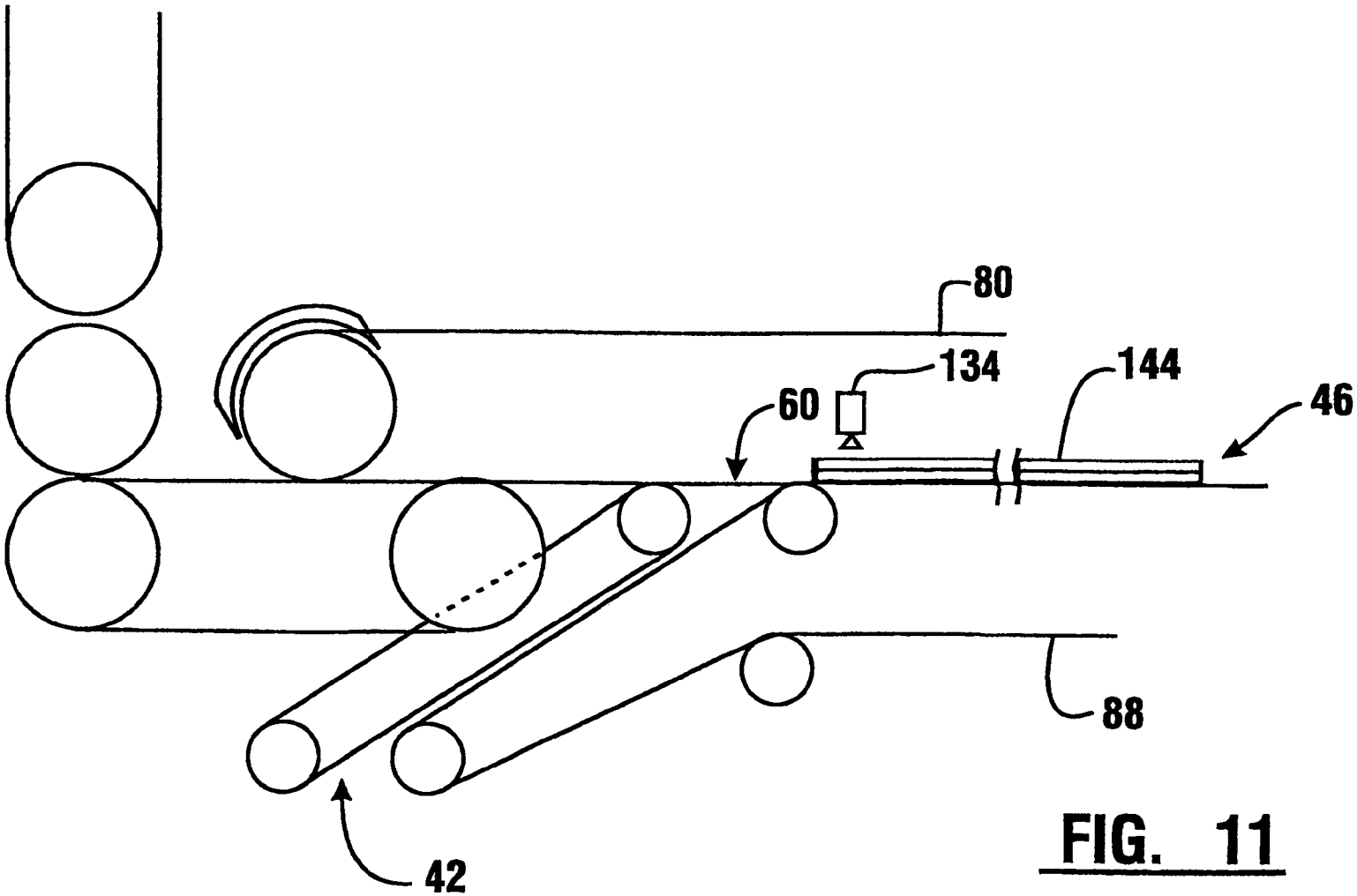
FIG. 11 is a schematic view similar to FIG. 10 in which the stacked pair of sheets have passed through the intersection.

As shown in FIG. 11 once sheets 140 and 132 have passed intersection 60 in the first direction, they are in a stack generally indicated 144. As schematically indicated in FIG. 11, in this mode of operation sensor 144 is operative to sense passage of the stack through the intersection and the control circuitry is operative to stop movement of the stack in the first direction in response to signals from the sensor. After sheets 132 and 140 have combined to form stack 144, additional sheets may be added to the stack. This is accomplished by moving the stack 144 in the second direction similar to that which is done with sheet 132 previously, as represented in FIG. 8. Stack 144 is moved to the position shown in FIG. 12 in which it is held by the holding device formed by holding rolls 108 and transport section 100. Thereafter, additional sheets may be added to the stack by passing sheets on transport path 42 and engaging such sheets in aligned relation with the stack in a manner similar to that represented in FIG. 10.

It will be appreciated that a stack comprising a significant number of generally aligned and abutting sheets may be formed in the manner described. Because the sheets are selectively dispensed from the dispensing devices and/or sheet producing devices adjacent to transport path 42, the sheets may be stacked in a desired order as determined by the control circuitry. For example, sheets which are currency notes may be stacked in order from highest to lowest denomination, or vice versa. Particular sheets may be placed in a desired location within the stack. Once the stack has been assembled in the desired manner by the control circuitry of the machine, it may be moved in first transport path 46 to the opening 20 so it may be taken by a customer.

Figure 12:
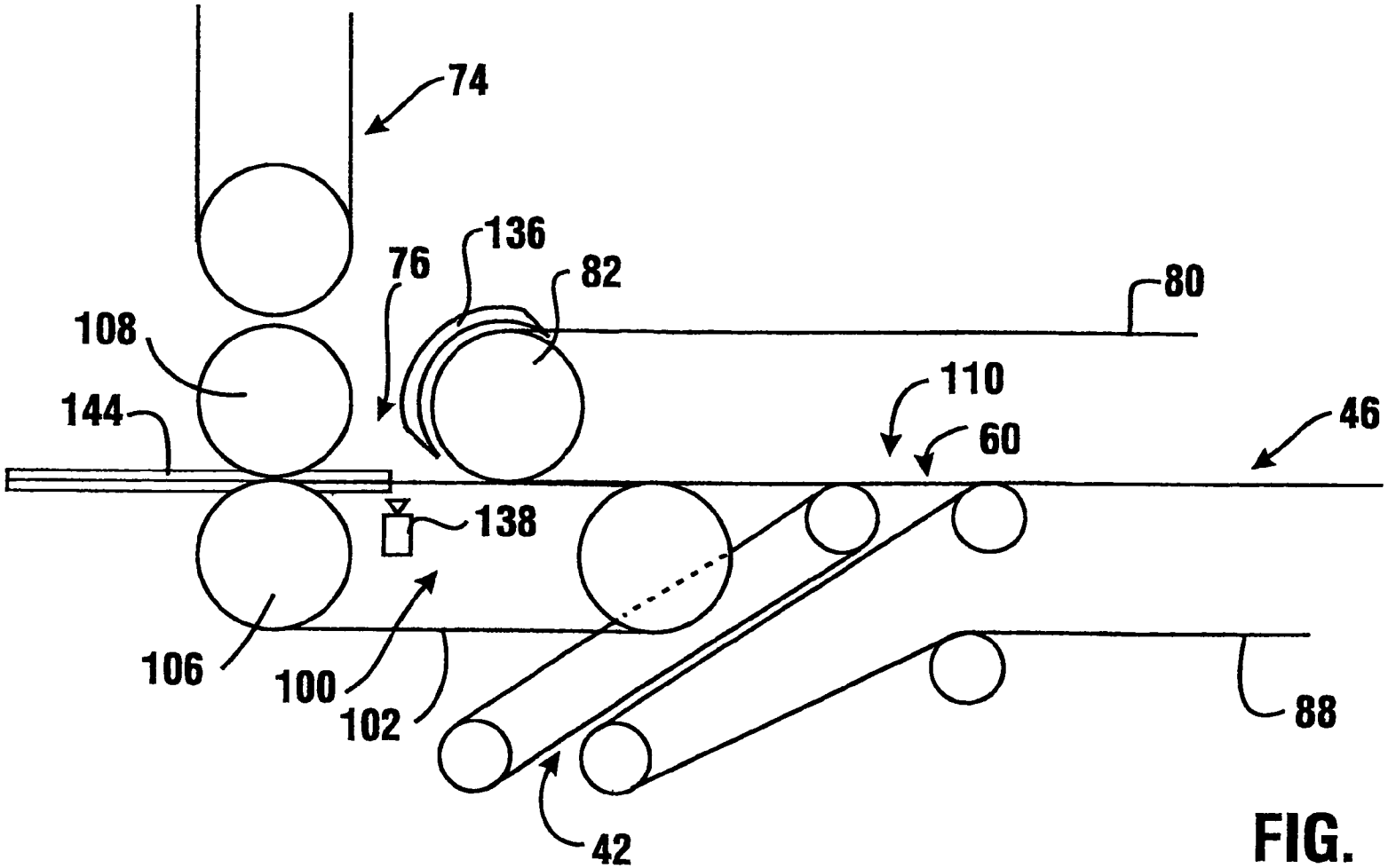
FIG. 12 is a schematic view similar to FIG. 11 in which the stacked sheets are held in the holding device.

It should also be noted that in the position of stack 144 shown in FIG. 12, the stack is positioned in the holding device formed by holding rolls 108 and transport section 100 adjacent to intersection 76. Intersection 76 is the intersection of transport path 46 and transport path 74. Transport path 74 extends to the devices housed in the upper enclosure portion 26 of machine 10.

Figure 16:
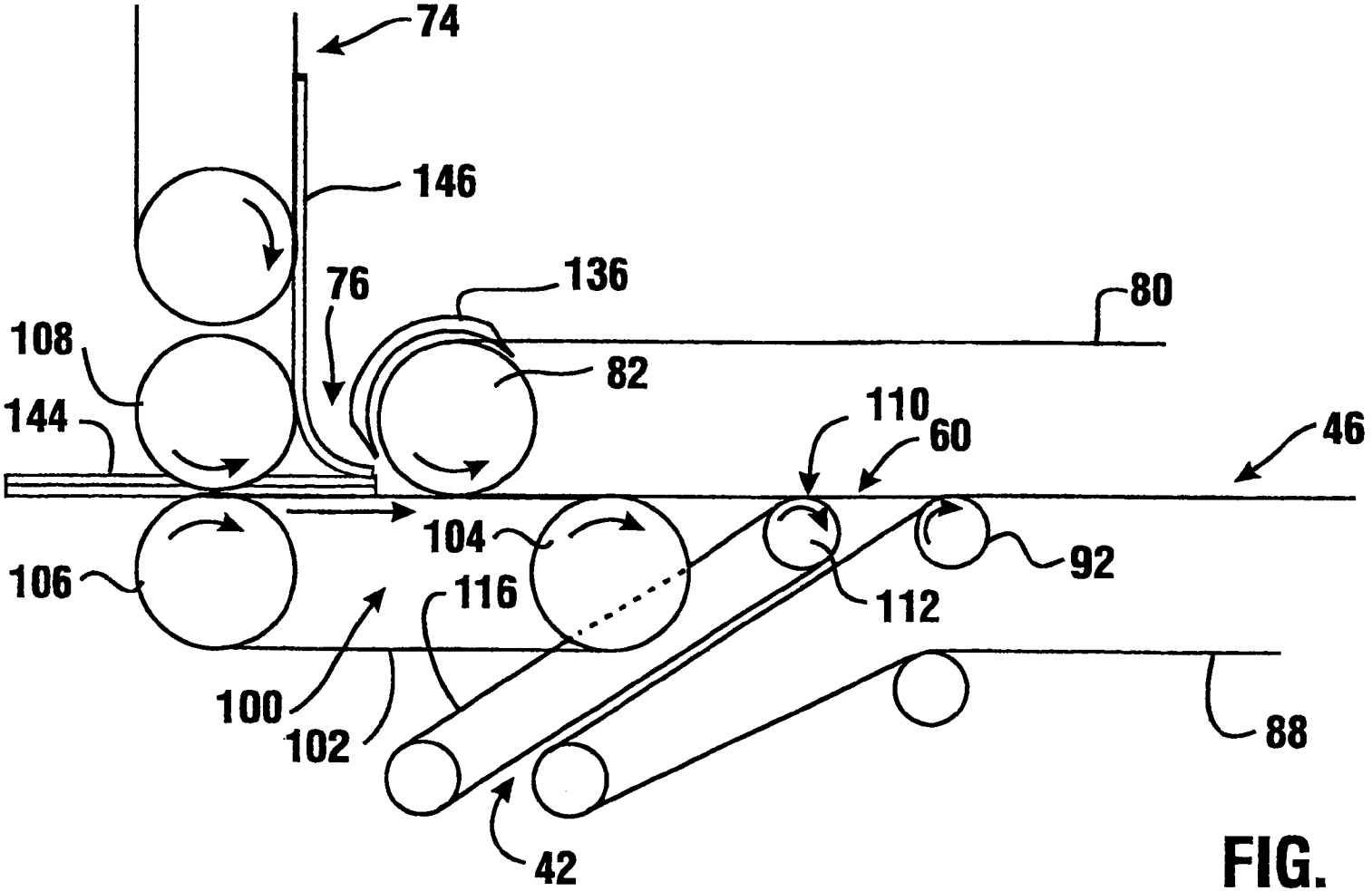
FIG. 16 is a schematic view showing a sheet passing through a second intersection between the first transport path and a third transport path.

As schematically represented in FIG. 16, a sheet 146 may be moved from one of the devices adjacent to sheet path 74 to engage the stack 144 at intersection 76 as the stack moves in the first direction. This enables adding sheets to the stack which are housed in the sheet dispensing devices and/or document producing devices adjacent to sheet path 74. The stack formed by the addition of sheets from sheet path 74 may be moved through sheet path 46 to the customer.

It will be understood that sheets from sheet path 74 may be delivered individually through intersection 76 into sheet path 46, and may thereafter be added to a stack formed at intersection 60 in a manner similar to that previously described. It should also be understood that sheet path 74 includes appropriate sensors that are operatively connected to the control circuitry. The control circuitry operates so that sheets from the sheet path 74 may be added to a stack in engaged, aligned relation with the other sheets in the stack as the sheets pass through intersection 76. As a result the associated structures operate as a further stack assembly mechanism.

Figure 15:
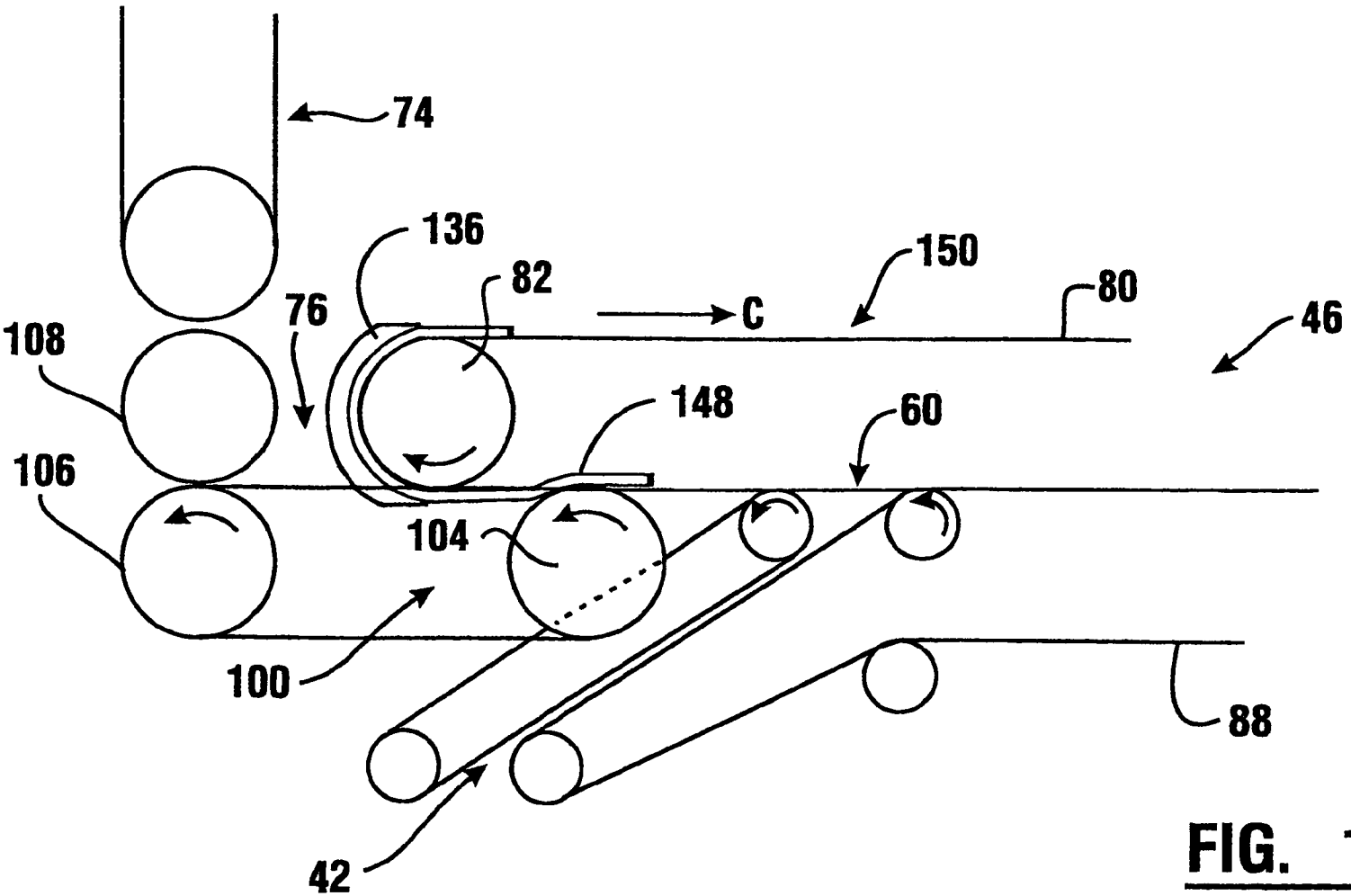
FIG. 15 is a schematic view of the first and second transport paths showing a sheet being reoriented by a sheet turnover device.

As shown in FIG. 15, exemplary machine 10 further includes the capability of taking sheets in the first sheet path and turning them over using a turnover device. This may be done as shown in FIG. 15, through the use of sheet turnover member 136. Exemplary sheet turnover member 136 comprises a member including arcuate guides or tines conforming to the contour of rolls 82. When the turnover member is positioned adjacent to rolls 82, such as in FIG. 15, a moving sheet 148 is caused to be turned over from the position of the sheet in the first sheet path 46. This is accomplished by moving sheet 148 in the direction of Arrow C in FIG. 15. In the exemplary embodiment the upper belt flights of belt 80 are part of a sheet path generally indicated 150. Sheet path 150 extends adjacent to printing device 70 and imaging device 72 shown in FIG. 3. As a result, the sheet may be selectively moved into sheet path 150 for purposes of conducting printing or marking thereon, such as by a cancellation device, for producing an electronic image of the sheet by an imaging device, or both. Of course other or different functions may be performed.

Once the printing or imaging activity has been conducted on the sheet in sheet path 150, the sheet may be returned to the first sheet path 46. Once the sheet 148 is returned to the first sheet path it may be selectively moved to one of the other sheet paths 42 or 74. From these sheet paths it may be directed into and stored in an appropriate sheet storage device or location in the machine. Alternatively, sheet 148 may be selectively moved to be combined in a stack with other sheets at intersections 60 or 76. This may in some embodiments provide for the delivery of cancelled checks to a user. Such cancelled checks may be delivered in a stack with other checks, receipts, notes or other documents.

In some embodiments the sheet turnover members 136 may be configured so that sheets in transport path 150 may be directly added to a stack of sheets at the intersection of sheet path 46 and the turnover device. This is accomplished by configuring or moving the turnover member so that the tines in the lower position do not interfere with the passage of a stack of sheets in the first direction past the turnover member. This feature provides yet another stack assembly mechanism and may be particularly advantageous when a customer receipt is printed on a sheet by the printer in sheet path 150, and it is desired to have the receipt at the top of the stack. This may be achieved by positioning the stack in the holding device formed by holding rolls 108 and transport section 100, and moving the stack in the first direction to the right in FIG. 15 as the printed receipt sheet is engaged in aligned relation with the top of the stack as the stack moves toward opening 20.

It should be understood that in other embodiments, sheets from paths 74 and 42, as well as from path 150, may all be added to a stack as the stack moves from the holding device provided by transport section 100 and holding rolls 108, in the first direction toward the customer. This can be readily envisioned from the schematic view shown in FIG. 16 with the stack 144 moving to the right as shown, and sheets being added to the stack as the stack passes roll 82 and again as the stack moves through intersection 60. As will be appreciated by those skilled in the art, numerous configurations and operations of the system may be provided depending on the functions carried out by the machine as well as the programming and configuration of the control circuitry.

Figure 18:
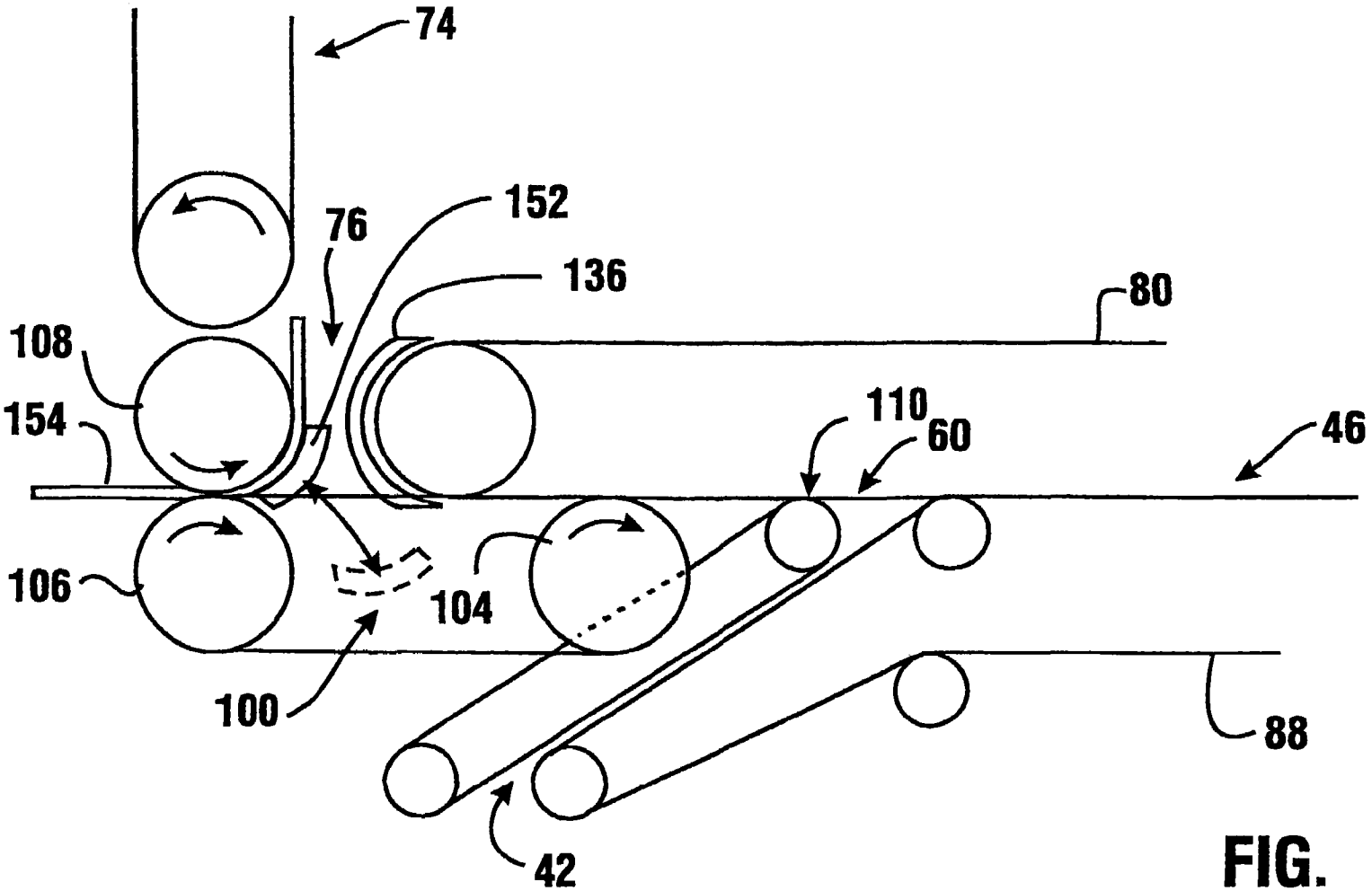
FIG. 18 is a schematic view showing the first, second and third transport paths, with a sheet moving from the holding device to the third transport path.

It should be understood that other sheet turnover devices, other than, or in addition to turnover member 136, may be provided in other embodiments. For example, in FIG. 18 a directing member 152 is shown in cooperating relation with roll 108. Directing member 152 is selectively movable between the position shown, wherein it is adjacent to roll 108 and the position shown in phantom. As represented in FIG. 18, when the directing member 152 is in the position shown it is operative to direct a sheet 154 that is held in the holding device formed by transport section 110 and holding rolls 108 into transport path 74. Sheet 154 may be moved in transport path 74 to a sheet handling device for storage therein in the manner previously discussed.

Alternatively, turnover of the sheet 154 may be accomplished by moving it into transport path 174 and thereafter disposing directing member 152 away from roll 108. Once this is done, sheet 154 may again be directed into path 146 and moved to the right as shown in FIG. 18 so that sheet 154 will move in a manner comparable to that of sheet 146 shown in FIG. 16. This will result in the orientation of sheet 154 being reversed in sheet path 46 from its original orientation.

The components adjacent to intersection 60 may also be operated as a sheet turnover device. This is represented schematically in FIG. 20. This is accomplished by having a sheet 156 initially positioned in the first sheet path similar to sheet 132 in FIG. 7. The sheet is then moved into the second sheet path at intersection 60 by operating the sheet directing apparatus 110 in a manner that is later discussed in detail. Once sheet 156 is in the second sheet path, the direction of belts 88 and 116 is reversed while the lower flights of belt 80 are moved to move the sheet in the second direction indicated by Arrow B. This results in the sheet being turned over from its original orientation in the transport.

Figure 20:
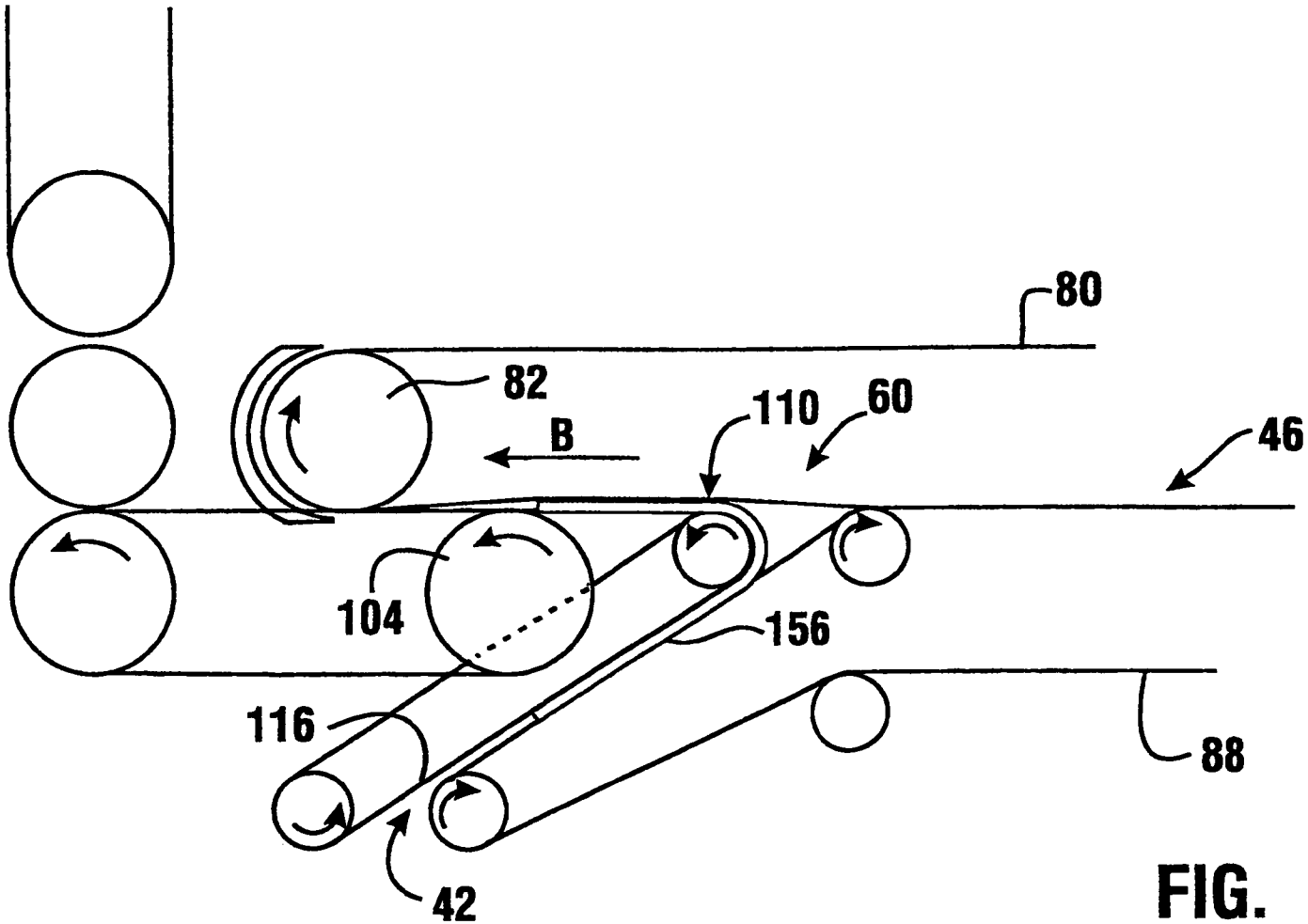
FIG. 20 is a schematic view showing the first and second transport paths with a sheet moving from the second transport path to the first transport path, and schematically demonstrating how the sheet directing apparatus is used as part of a sheet turnover device.

It should be further understood that sheets which originate in transport path 42 may also be directed in the manner shown in FIG. 20. This feature enables selectively positioning sheets and turning them over through a number of different mechanisms this enhances the capabilities of the exemplary automated banking machine.

Figure 13:
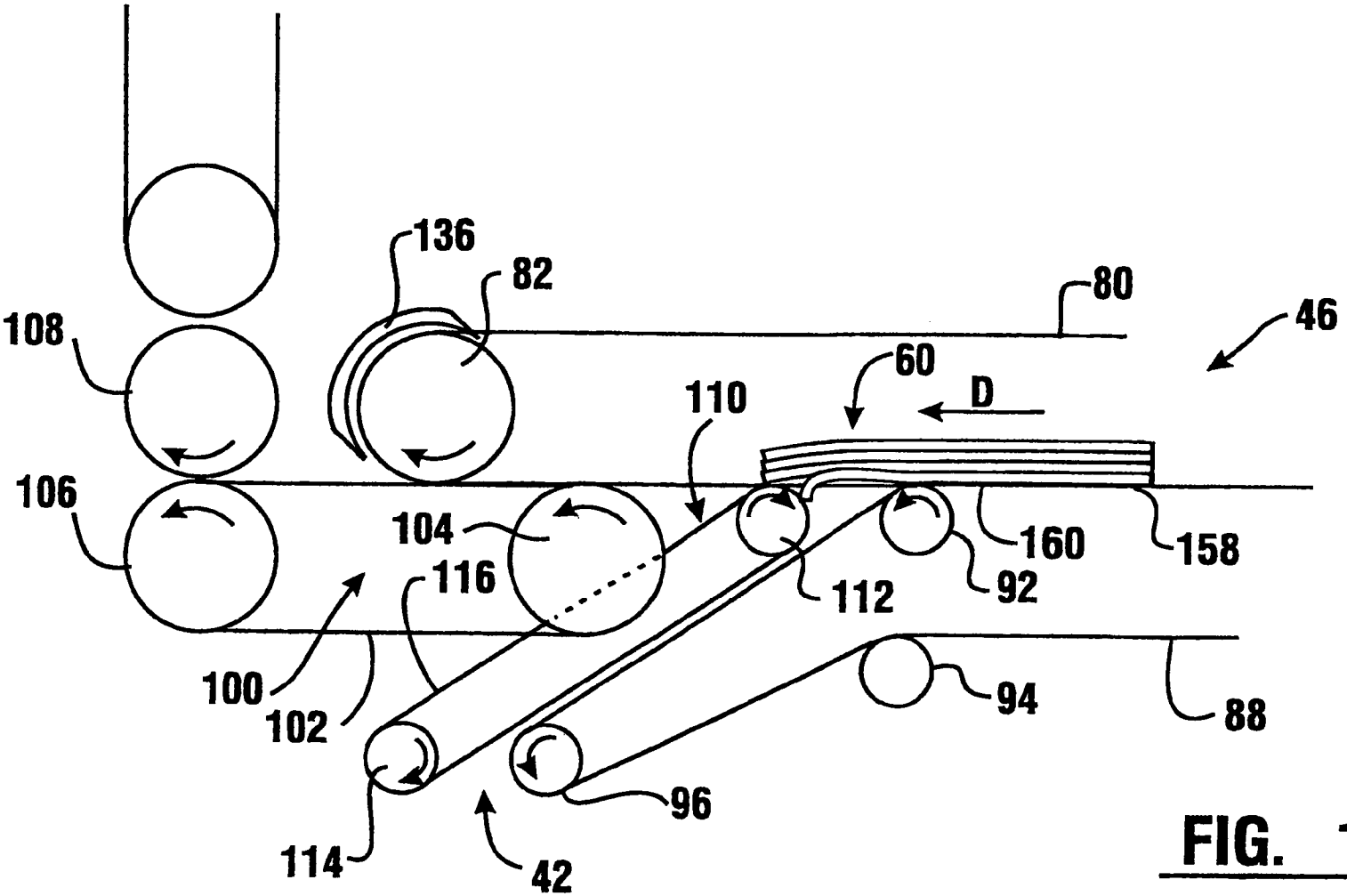
FIG. 13 is a schematic view of the first and second transport paths with the sheet directing apparatus operating to separate a first sheet from a stack as the stack passes through the intersection.
Figure 14:
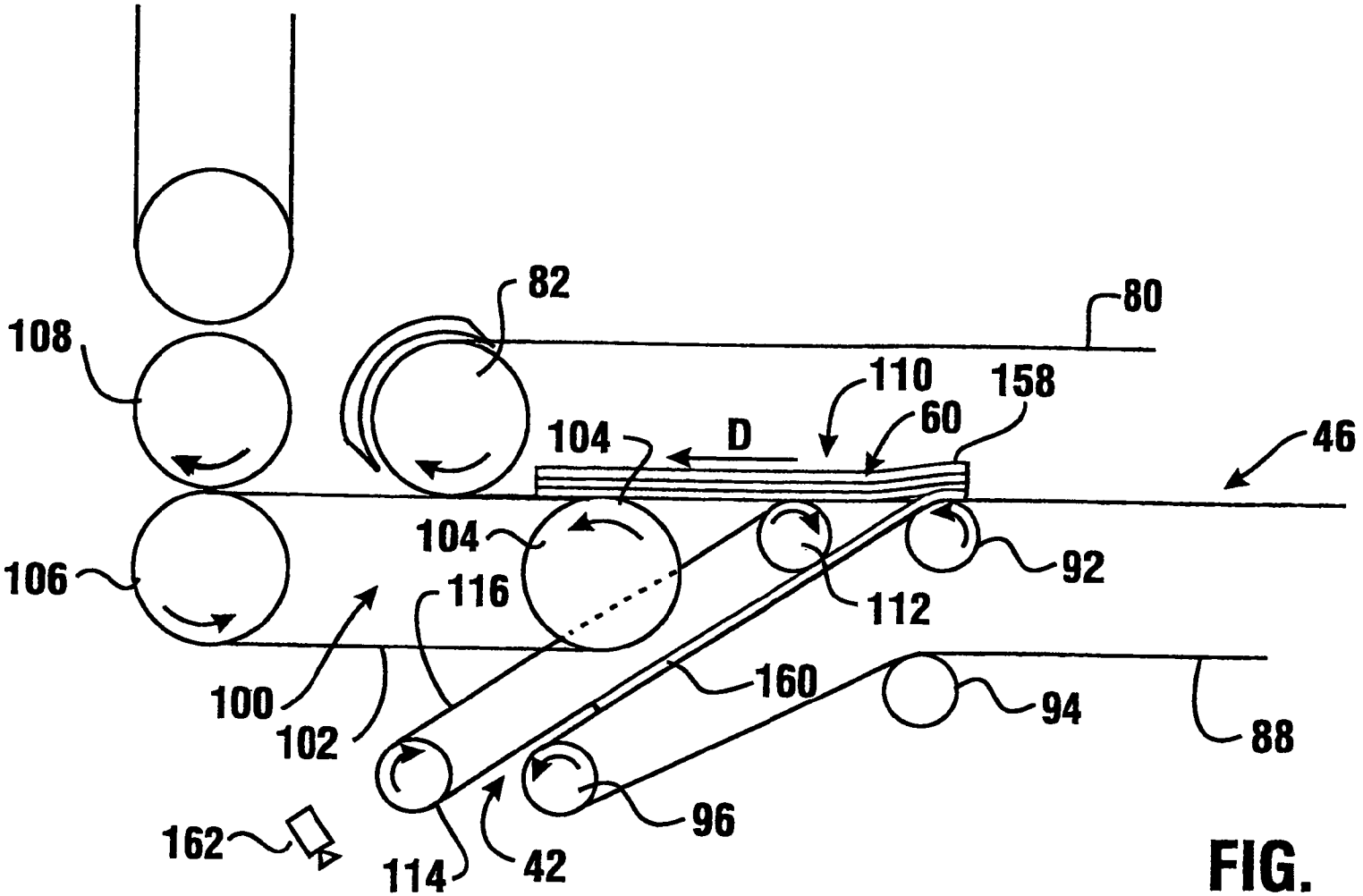
FIG. 14 is a schematic view similar to FIG. 13 showing the sheet separating from the stack as the stack passes through the intersection.

A further useful aspect of the exemplary embodiment is that it includes a separating mechanism for separating sheets from a stack as represented schematically in FIGS. 13 and 14. The exemplary embodiment shown includes the capability of selectively separating a sheet from a stack of sheets as the stack passes through the intersection 60 of transport path 46 and transport path 42. As schematically represented in FIG. 13, a stack of sheets 158 moves in the direction indicated by Arrow B in transport path 46. Although stack 158 is shown as a stack of four sheets, it should be understood that the stack may comprise a greater or lesser number of sheets. Stack 158 may be a stack of sheets received from a user of the machine through opening 20 and may consist of different sheet types. For example, in some embodiments stacks accepted in the machine may include stacks of mixed notes, checks and/or other types of sheets As stack 158 moves toward intersection 60 the control circuitry of the machine operates sheet directing apparatus 110 so that rolls 112 and 114, and belts 116 journaled thereon, move relative to the stack in a direction opposed to the direction of stack movement. As a result of this movement by the sheet directing apparatus, a first sheet 160 which bounds a first side of the stack, is frictionally engaged by belts 116 and is stripped and separated from the stack. The first sheet 160 is directed into the sheet path 42 as the stack which comprises the remaining sheets continues on path 46. This enables sheet 160 to be handled separately by the devices adjacent to path 42, or to be later brought individually back to path 46 for individual transport to devices adjacent to other paths.

It should be noted that in the exemplary embodiment a sensor 162 is positioned adjacent to path 42. Sensor 162 may be a photo electric sensor connected to the control circuitry for sensing the position of the sheet. Alternatively, sensor 162 may comprise a plurality of similar or different sensors adapted for sensing features of a sheet. Sensor 162 may be part of a validation device such as that previously discussed that is suitable for determining note type and denomination. This enables the control circuitry to properly identify a currency sheet and place it in a designated note handling mechanism, storage position or other the sheet receiving device. Sensors 162 may alternatively operate in connection with the control circuitry to provide a validation mechanism to determine or assess the genuineness of a sheet. In other embodiments other features such as magnetic ink indicia, bar coding and other features may be detected for purposes of identifying the type of sheet as it moves past the sensors.

As previously mentioned, sensing devices in combination with the control circuitry (or a computer) in the machine may comprise a validating device for assessing the validity of notes or other documents. A validation arrangement can comprise sensing devices, control circuitry, one or more computers, one or more validating devices, or combinations thereof. In some embodiments the validation device may be operative to identify particular sheets, such as by serial number or other characteristics. In some embodiments such information may be stored for suspect notes, and in others embodiments such information may be stored for all or certain selected categories of notes. Such data concerning individual notes may be stored in a data store in correlated relation with information usable to determine the identity of the user who provided the note to the machine. Other data may be stored as well, such as for example, the storage location or position where the note is stored in the machine or other information that can be used to recover the particular note and/or to document the transaction. The validation device or the control circuitry (e.g., a computer) can communicate with the data store to cause storage and retrieval of the correlation data therewith.

In an exemplary embodiment an automated banking machine (e.g., ATM) is associated with a data store which holds identifying information related to notes for purposes of comparison to notes provided or deposited to the machine. The automated banking machine may receive currency notes in any manner, including receiving notes individually inserted into the machine. The automated banking machine may also receive notes together as a stack of notes. The automated banking machine may also receive notes via a deposit envelope (containing notes) that was deposited into the machine. In some embodiments the identifying information can correspond to properties, characteristics, or numbers associated with known counterfeit or invalid notes. Such information used for comparison may also include identifying data for individual notes already deposited in the machine. Thus for example, if a note provided to the machine is individually identified by determining its serial number, the serial number may be compared through operation of the control circuitry (e.g., one or more computers) to stored data for serial numbers of known counterfeits. Alternatively or in addition, the serial number of the note provided to the ATM may be compared to serial numbers for notes previously deposited or input in the machine. In the event of a match in either example, the control circuitry can act in response to the apparent suspect note in accordance with its programming. This action may include capturing and storing the suspect note, capturing additional data about the user presenting the suspect note, notifying authorities, or taking other action.

In embodiments where identifying data on all notes is captured and used for comparison, the control circuitry may operate to indicate when the note has been dispensed out of the machine. This may include for example deleting the information about the dispensed note, such as deleting its serial number from the data store upon its dispense. Alternatively, such indication may include storing the information indicative that the particular note has been dispensed. The information about the note dispensed may in some embodiments be stored in correlated relation with information unable to identify the user who received the note from the machine. Of course other approaches may be used in other embodiments and the approaches discussed with regard to notes may also be applied to other types of documents.

In an exemplary embodiment the automated banking machine (e.g., ATM) is operative to receive at least one currency note therein from a machine user. The machine user can be a person (e.g., a depositor) performing or attempting to perform a currency note deposit. The machine includes at least one currency note inlet or opening. The machine is operative to receive therein currency notes from a person via a currency note inlet. The machine includes control circuitry having at least one control computer containing software. The machine includes a note validating device. The validating device can comprise the control computer, or in other embodiments the control computer can be distinct from the validating device yet be able to communicate therewith. The validating device is operative to assess the validity of currency notes received into the machine. The machine includes at least one data store. For example, one data store can contain invalid, suspect, and/or counterfeit note data, such as note serial numbers. Another data store can contain note to person correlation data. In other embodiments a single data store may be used for storage of all data. The validating device can read the serial number of a note, such as a note received from a machine user. The read serial number can be compared through control of the control computer (or the validating device) to the stored serial numbers to determine whether the received note is suspect (e.g., counterfeit). In response to determining a currency note of suspect validity, the computer (or the validating device) can operate to cause the generation of data that can uniquely identify the suspect note and identify a person associated with the suspect note (e.g., the person from whom the note was received by the machine). The computer (or the validating device) can cause the storage in the correlation data store of data linking the suspect note to the person. Data usable to identify a person can be received from the person's input to the machine. The person's identifying data can correspond to data received in an input of an account number input and/or a biometric data. In a data storage example, the serial number of the suspect note can be stored together with the person's account number. This data may be stored as a continuous string of numbers (i.e., serial and account numbers). Alternatively, suspect note data may be stored separately from the user identifying data. For example, the serial number of a suspect note may be stored together with the storage location identifier of the user identifying data. The storage location identifier can be used to point to or retrieve the user identifying data. Conventional data storage configurations may be used. The stored data is retrievable so that it can later be used to particularly identify the suspect note, the person, and the correlation or relationship therebetween. The suspect note can be stored in a separated note storage compartment designated for suspect notes. The recorded and stored serial number of a suspect note enables the particular suspect note to be later identified and retrieved, even though it may be stored together with other (suspect) notes.

It should be understood that in other exemplary embodiments the one or more data stores can be remotely located from the automated banking machine (e.g., ATM). Likewise, the comparison of data and the determination of whether a received note is a suspect note (e.g., counterfeit currency note) can be carried out remote from the machine. For example, the automated banking machine can be one of many machines connected by network with a banking network host. The banking network may include a private network. Alternatively, the network may include use of the Internet or some other publically available network. The network host can include the data store(s) and perform the suspect note comparison and determination functions. An automated banking machine can read the note data (e.g., a serial number) and receive the user input data (e.g., an account number or biometric identifier). The machine can then transmit the note information and the user information to the host for processing. The host can then use the data store to make a comparison for purposes of determination on whether the note received by the machine is suspect. Upon determination of a suspect note, the host can store correlating note/depositor data in a data store. The host can also instruct the machine on how to treat or handle the received note responsive to the determination. For example, the machine may be instructed to accept and store a note that was determined to be valid. Upon determination of a suspect note, the host may instruct the machine to either return the suspect note to the depositor or store it in a suspect note storage compartment or some other note handling function. Prior to a determination by the host, the machine may store received notes in temporary storage until instructed by the host on how to handle the notes. It should be understood that in some embodiments the depositor identifying data isn't transmitted from the machine to the host until the note is actually determined or classified as suspect. Upon determination of the note as suspect, then the depositor identifier information can be sent to the host so that it can be placed by the host in correlated storage with the note identifier.

Alternatively, the host (or the machine) may be in communication with and use other remote sources (e.g., other computers and data stores) that are operative to carry out one or more steps in the suspect note data handling process. For example, a central computer system (e.g., a Government computer system) can include a large centralized data store of known suspect notes. The host (or an individual automated banking machine) is able to communicate with the central computer system to perform a suspect note comparison using the central data store. Different banking systems (e.g., different hosts) can use the same central data store for suspect note determinations. Either a host or the central computer system can perform the note ID comparison and suspect determination. The central computer system can keep the central data store updated by adding new suspect note data thereto. A host or a machine may also be able to contribute to the update. For example, the central computer system can permit suspect note data to be transmitted thereto by a host or a machine for addition to the central data store. As herein described, not all functions in a suspect note determination process have to be carried out locally at an individual automated banking machine.

In another exemplary embodiment, the note identifying device (e.g., a serial number reader or validation device) can be remotely located from the automated banking machine. For example, the host may comprise the data store and a serial number reader (e.g., the validation arrangement). The automated banking machine can include an imaging device. The imaging device may be of the type which enables reading and generating an electronic image of a document. The imaging device may capture data corresponding to features, properties, and/or characteristics that can be visually perceived and/or (in some embodiments) may capture non visible features, properties, and/or characteristics. An exemplary apparatus and method for capturing image data from a currency note may be found in 10/426,068, the disclosure of which is incorporated herein by reference. The imaging device can be part of or in communication with a validator device or validator arrangement. The ability to capture an image from a currency note enables correlating particular notes with particular machine users (e.g., a note depositor) or a particular machine transaction (e.g., receiving a note deposit). The imaging device at the machine can operate in conjunction with a (control) computer to produce signals which comprise an electronic representation of an image of a received currency note or an image of at least a portion (e.g., the serial number or some other unique identifying feature) of the note. The machine can transmit one or more electronic images pertaining to a received currency note to the host. The host (or other suspect note determinator) can then perform the validation and determination steps. For example, the serial number can be ascertained at the host from the received note image using a reader comprising character recognition capabilities. The host can then compare this ascertained serial number to serial numbers in a suspect note data store to determine whether the received note is suspect. The depositor identifier can be stored in correlation with the ascertained serial number and/or the received note image by the host. Alternatively, the host may transmit the ascertained serial number to the machine, so the machine can perform the storage of the depositor identifier in correlation with the ascertained serial number and/or the note image. The host, following a note determination, can accordingly instruct the machine having the note on how to handle the note.

Similarly, an automated banking machine can include an imaging device (e.g., a camera) that can capture one or more images of a person (e.g., a note depositor) adjacent the machine. A depositor image can comprise one or more specific features of a person, such as a facial image. The captured facial image can include facial recognition features that are readable by a computer using facial recognition software. The image can be used to particularly identify the person. A depositor's captured image can be used as a depositor identifier in the same manner as inputted account number data or other biometric data. A person's identifying image data corresponds to data (e.g., facial features) inputted or provided to the machine by the user. Thus, the imaging device can comprise an input device. Captured user image data (or data corresponding thereto) can be digitally stored at a data store in linked relation with suspect note identifier data. Again, the invention provides for either a machine, a host, or another system to perform the correlated storage in a data store of depositor identifying data and suspect note identifying data.

The facial recognition software can be used to determine a repeat depositor of suspect notes. The facial image can be compared to facial images in a data store that have been linked to suspect notes. The facial comparison can lead to a match of a person who attempts to deposit counterfeit notes into someone else's account and then withdrawals an equal amount of cash from the same account without the owner ever becoming aware of the money laundering activity.

As previously discussed, a data store (or memory) containing suspect note/depositor correlation data may be located at the machine, at a host, or at some other remote facility. A depositor's captured image can be used instead of or in addition to some other stored depositor identifier (e.g., account number, biometric input data). That is, the image of a depositor of suspect notes can be used as the identifier of the depositor. An image of the suspect note depositor may be stored in correlation with an identifier (e.g., serial number) of the suspect note. The identifier of a suspect note may also comprise an image. Thus, an image of a suspect note may be stored in a data store in correlation with the image of the suspect note's depositor. The images may be digitally stored. Image data may be compressed to minimize storage capacity needed and/or encrypted to provide enhanced security. A suspect note image and a depositor image may also be combined or overlaid for storage as a single image. The single note/depositor image may have additional information recorded therein, thereon, or therewith (e.g., imaged therein or printed thereon). Such additional information may comprise an account number, biometric input data, user name, note serial number, note denomination, validity status, transaction number, machine ID, bank ID, date, and/or time. In some embodiments digital watermarks or other features may be stored in or in conjunction with image data. These watermarks and/or other features can be used in verifying the integrity of image data, e.g., verify that the image data has not been subject to modification subsequent to being captured.

In other embodiments, the previously mentioned central computer system (e.g., Government system) can include the validation arrangement. For example, a central computer system can include a suspect note data store, a validating device, a suspect note determinator (which may be a part of the validating device), and a suspect note/depositor correlation data store (if not part of the suspect note data store). A host or automated banking machine can transmit the note information and depositor information to the central computer system. The central computer system can then perform the needed note validity and suspect determination steps. As previously discussed, the transmitted note information may comprise data representative of the note's serial number and/or an image of the note. Likewise, the transmitted depositor information may comprise data representative of the user-inputted account number and/or biometric data including for example, an image of the depositor.

Figure 24:
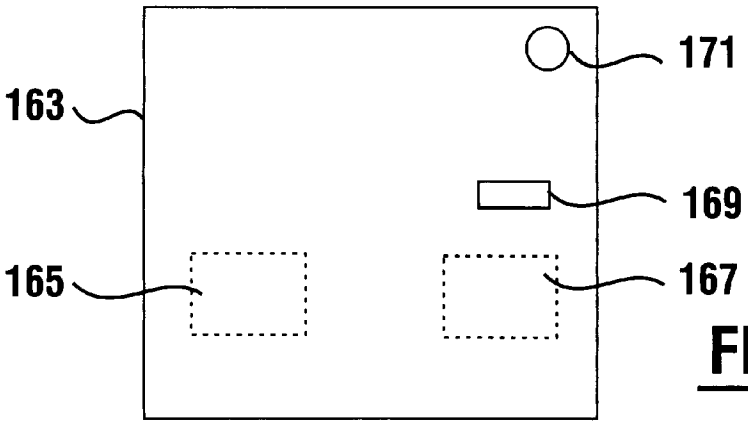
FIG. 24 shows a note validator arrangement comprising an automated banking machine having a note deposit inlet, imaging device, validator device, and correlation data store.

FIG. 24 shows an automated banking machine 163 including a correlation data store 165, a currency note validator device 167, a currency note receiving inlet 169, and a depositor image capturing device 171. The automated banking machine includes suitable devices for communicating with one or more remote computers.

Figure 25:
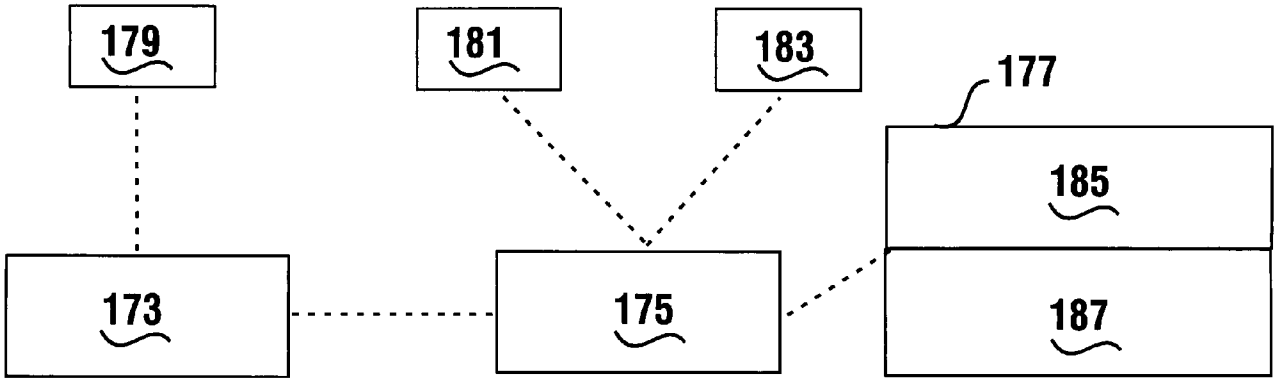
FIG. 25 shows an arrangement of an automated banking machine, host, and central computer system that can be used to carry out a suspect note determination and storage process.

FIG. 25 shows an arrangement comprising an automated banking machine 173, a host 175, and a central computer system 177. The machine 173, host 175, and system 177 are in operative connection or communication. Communication may be through one or more public or private communications networks or systems. The automated banking machine 173 can be in communication with a data store 179 which may be in the machine (as shown in FIG. 24) or remotely located therefrom. The automated banking machine 173 can also be in communication with its network host 175. As previously discussed, in some embodiments the automated banking machine 173 can transmit currency note information and/or machine user information to the host 175. The host 175 can use the received information to perform one or more of the necessary suspect note determination and storage steps. The host 175 can use a validator 181 and a data store 183. The validator 181 and data store 183 can be a part of the host 175 or in communication therewith. In the exemplary embodiment the host 175 can also transmit note information and/or machine user information to the central system 177. The central system 177 can perform one or more of the necessary suspect note determination and storage steps by using a central validator 185 and a central data store 187. The central validator 185 may include one or more computers. As previously discussed, different functions in a suspect note determination and storage process can be carried out by different devices at different locations. As previously discussed, in some embodiments the banking machine may communicate some messages directly to the central computer 177.

As herein described, not all functions in a suspect note determination process have to be carried out locally at an individual automated banking machine. As previously discussed, the storage of known suspect note data, the note validation process, the suspect note determination process, and the correlated storage process of linking suspect note identifier data to depositor identifier data may be carried out locally at a machine, remotely at a host, remotely at some other system (e.g., a central computer system) in communication with the machine or host, or any combination thereof.

It should be understood that a validation arrangement can comprise one or more automated banking machines, one or more sensing devices, one or more data stores, control circuitry, one or more computers, one or more note validating devices, one or more suspect note determinators, a host, a central computer system, a central data store, or any combination thereof. Also, the validation arrangement can carry out the oversight and handling of a suspect note data store, the note validation process (e.g., reading a serial number), the suspect note determination process (e.g., determining whether a note is suspect based on comparing the read serial number with suspect serial numbers in the suspect note data store), and the process of storing suspect note identifier data in correlated relation with depositor identifier data in a data store (which may be the suspect note data store).

It should also be understood that a note or its deposit can be deemed suspect even though its identifier does not match a previously stored suspect note identifier. A particular machine user can be linked to a particular note for other reasons. A note may be deemed suspect based on it having unacceptable properties, characteristics, qualities, and/or features. For example, a worn or torn note may be determined or indicated as suspect by an automated banking machine's note validator device. Conventional standards for qualifying a note as suspect may also be used. It follows that a note may be deemed suspect without the need to compare it to data in a data store. Thus, the comparison of a note identifier to data in a suspect note data store may be viewed as a secondary validation process in the determination of whether a note is suspect.

Actions or a series of actions by a depositor may also be used to treat a deposit (or the notes therein) as suspect. For example, a plurality of deposits within a relatively short predetermined period of time may be treated as suspicious and suspect. A deposit containing more than one note (which individually pass validation) with the same serial number would also be suspect.

Alternatively, in some embodiments one or more sensors, which may be additional sensors or other types of sensors, may be provided in the machine which receives the notes (e.g., currency bills). These sensors may operate in connection with one or more computers to determine other properties associated with deposited notes, such as the detection of certain substances thereon. This action may include, for example, the detection of materials such as dyes or other elements used in the tracking or identifying of stolen or illicit notes. Some embodiments may detect substances on notes that may be associated with illicit activities. Such substances may include narcotics, explosives or materials involved in explosives, radioactive materials, elements or materials involved in or associated with nuclear reactions, or other materials. Some embodiments may identify a note or an associated transaction as suspect based on a detectable level of one or more such substances or materials. Other embodiments may treat notes and/or transactions as suspect based on a level of a detected substance being above a predetermined or programmed threshold. In still other embodiments, detectable levels of substances may result in reporting of the note or transaction data along with the nature of the substance and an indication of the rejected level. Such report data may be delivered from the banking machine to the host and/or the central computer either directly or through other computers and communications. The information provided concerning the nature and level of detected substances may enable one or more computers to track notes and/or individuals associated with suspected illicit activities. It should be understood that these approaches are merely exemplary of many that may be used.

In other embodiments, notes deposited into an automated banking machine may be sensed or analyzed for one or more identifying features (e.g., fingerprints, genetic material, etc.) of a handler of the note. For example, a sensed fingerprint may be lifted (read) from a note and then compared to fingerprints in a data store. The data store can contain fingerprints (or data representative thereof) of individuals wanted by law enforcement agencies. Thus, in an exemplary embodiment an automated banking machine can be used to track or locate (or narrow the location of) wanted individuals, including persons who may have altered their physical appearance and/or identity. Likewise, information acquired from a note may be used to determine that an individual is using a stolen identity. One or more sensors, computers, and data stores may be used in finding an identifying feature on a note and then linking the identifying feature to a specific individual. Local or remote computers and data stores may be used. It should be understood that in other arrangements, notes that may have been provided to the machine by some other manner (e.g., a bank employee) may also be analyzed for fingerprints, substances, etc. and compared to data in a data store prior to dispensing the notes to a customer.

In other embodiments, the analysis of a deposited note may be linked to one or more other notes also being currently deposited into a machine by the same user. For example, a single note may have several readable fingerprints thereon. The linking of common note characteristics can assist in determining the user's identifying feature. This ability may enable the user's identifying feature (e.g., fingerprint) to be more quickly ascertained. The analysis enables the fingerprints on one note to be compared to fingerprints on one or more of the other notes being deposited. In certain analyzing arrangements, the fingerprints detected on each note are compared to the fingerprints detected on all of the other notes being deposited. Analysis programming may be based on the analytical and statistical reasoning that the user's fingerprint should be the fingerprint most common to all the notes being deposited.

Software instructions can be carried out to determine the most common fingerprint. The comparisons may occur at the machine level, at a host, and/or at a remote central computer. The most common fingerprint read from the notes being deposited can be the fingerprint selected for comparison with the fingerprints in the data store. It should be understood that data representative of fingerprints (e.g., electronic data, digital data, image data) may be used in the mentioned fingerprint comparisons.

Other embodiments may use other processes for selecting which fingerprint corresponds to the user (e.g., depositor). For example, a fingerprint may be selected based on it being the most frequently found fingerprint on all the notes being deposited. In another example, the freshest fingerprint may be sought from among one or more of the deposited notes as the fingerprint to select for comparison with the fingerprint data store. The fullest or most complete fingerprint may be selected with the reasoning that it is the freshest because time has not yet allowed its degradation. The analysis may include using different grades of fingerprint completeness. Another fingerprint may be selected because it was determined to be the freshest based on its higher moisture content, or other properties and characteristics. Another fingerprint may be selected because it was detected in a hot zone of a deposited note. For example, a thermal scan of a deposited note may be used to reveal the location (e.g., the hot zone) where the note was most recently touched. A useable fingerprint determined as being obtained from this location can then be selected as the user's fingerprint. It should be understood that combinations of the embodiments described herein may also be used. As can be appreciated, in exemplary embodiments a banking machine may be able to enhance security.

In exemplary embodiments the banking machine may operate to communicate data corresponding to image data and/or the detection of substances or conditions through the execution of software instructions that are executed in one or more processors (e.g., computers) in the banking machine. In exemplary embodiments the software instructions may comprise agent software that is stored in one or more data stores in the banking machine. The data stores may include storage media for storing the instructions executable by the processor, such as a hard disk, memory card, firmware, CD, floppy disk, or other suitable storage media. In exemplary embodiments the agent software may be loaded into the data store in the banking machine electronically by communications with a remote computer or source. Alternatively, agent software may be loaded to the banking machine from portable media bearing such executable instructions, such as a CD, floppy disk removable hard disk, memory card, or other portable device. In some embodiments the instructions comprising the agent software can be loaded into memory in a banking machine through suitable media reading devices, such as a CD drive, floppy drive, communications connection, or other suitable device.

In some embodiments methods may be employed for configuring or modifying agent software or other software in the banking machine and/or host through remote communications. This may be accomplished in some embodiments through approaches like those described in U.S. Pat. No. 6,672,505, the disclosure of which is incorporated herein by reference. Such capabilities may be used, for example, to provide additional capabilities to the software, such as to analyze additional or modified note types. Such capabilities may also be used to cause the image data to be analyzed for additional or other features, such as for example, features that have recently come to be known to be associated with counterfeit notes. Such capabilities may also be used to activate or deactivate sensing capabilities, adjust threshold levels, change communication parameters such as the type of data communicated and/or the remote computers to which data is reported, as well as to change other features. In some alternative embodiments software configuration changes may also be employed to cause the banking machine to change its outputs or otherwise modify the manner in which the machine interacts with a user based on image or other data detected. For example, such changes may alert the user to problems, provide instructions, facilitate the gathering of additional information, or enable the apprehension of criminal suspects. Of course these approaches are exemplary of many that may be used.

In exemplary embodiments, a banking machine (or a banking network of machines) may also be used to help determine whether an individual is a criminal. A banking machine can be loaded and programmed to dispense predetermined identifiable notes (e.g., "marked" notes) to a user being suspected of criminal activity. A dispensed marked note or a substance found thereon may later be used in the determination of criminal activity. A marked note may be identifiable by its serial number or some other unique feature. Data representative of a particular individual (e.g., an account number, social security number) may be listed in a data file corresponding to suspect individuals. The data file may be generated by the banking system and/or by legal authorities. The marked notes may be used (e.g., tracked) by the authorities to determine whether the user actually is involved in criminal activities. For example, a marked note may left at the scene of a crime. In another example, the marked notes may be dispensed as new and clean. Alternatively, the marked notes may include a dye or material that changes upon contact with a particular illegal substance. The change may only be detectable with one or more special instruments (e.g., change is undetectable to the naked eye). The suspected individual may be found in possession of a marked note having the changed dye. A banking machine may be equipped with an instrument capable of detecting a changed dye. Thus, a marked note having an illegal substance thereon or having a changed dye may be detected by a banking machine during the deposit of the marked note into the machine. The banking machine can be used to link the deposited marked note to the suspected individual.

It should also be understood that in some embodiments all deposit transactions involving an automated banking machine may be recorded by linking the particular identity of the deposited notes to the particular identity of the depositor. This recordation enables a deposit transaction that later comes into question to be reviewed by retrieving and analyzing the data associated therewith. Furthermore, the deposit of a note by a depositor may be a temporary deposit, because a suspect note may be returned to the person instead of being kept by the machine. Even though a suspect note may be returned, data linking the particular note to a particular person may still be stored in a data store.

Returning to the discussion of the operation of the separating mechanism, after sheet 160 is separated from the stack 158 as shown in FIG. 14, the control circuitry may operate the transports in the first path 46 to move the remaining stack to a position to the right of the intersection 60. If it is desired to separate an additional sheet from the stack, the remaining sheets may be moved through the intersection again in the direction of Arrow D to accomplish separation of the sheet that is newly bounding the side of the stack. Alternatively, if the control circuitry determines that it is not necessary to separate a further sheet from the stack, the sheet directing apparatus may be operated so that belts 116 and rollers 112 and 114, move in the same direction as rollers 92 and at a similar speed. This will result in the stack passing through the intersection without a sheet being separated from the stack.

It should be understood that while in the embodiment shown the sheet directing apparatus comprises a plurality of rolls having resilient surfaces thereon that move at a relative speed that is less than the speed of the moving stack, in other embodiments other types of stripping and separating devices may be used. These may include for example, resilient pads or rolls. Such devices may also include resilient suction cup type mechanisms or vacuum generating devices. Further alternative forms of sheet directing devices may include other physical members that engage selectively one or more sheets so as to direct them from path 46 into another path 42.

Figure 23:
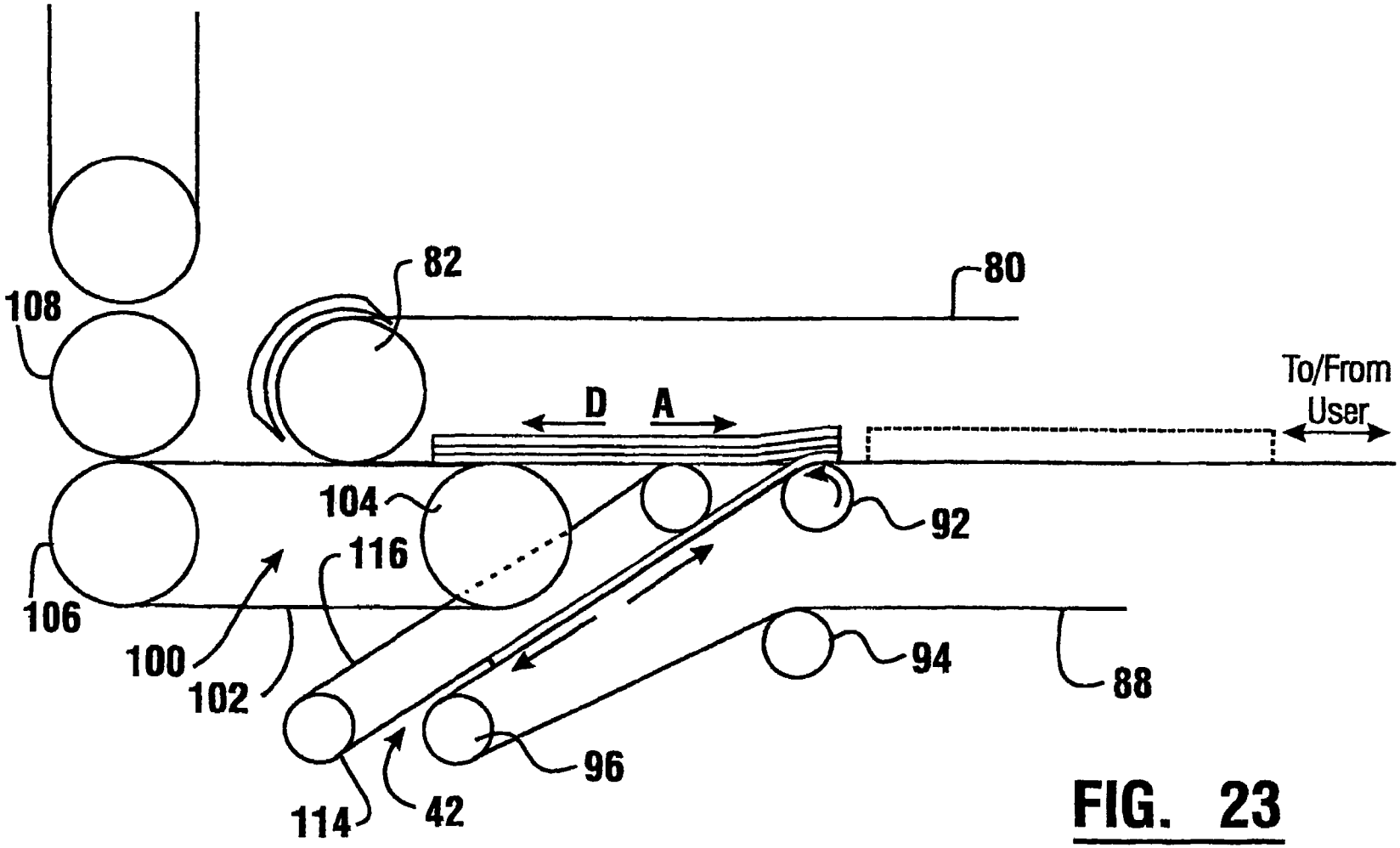
FIG. 23 is a schematic view showing a sheet separating from or adding to a stack as the stack passes through an intersection.

It should also be noted that in the exemplary embodiment shown in FIGS. 13, 14 and 23, sheets may be separated from a stack as the stack moves from right to left. However, in other embodiments it may be desirable to arrange the sheet directing apparatus so that sheets may be separated from a stack when the stack moves in either direction. This may be readily accomplished through arrangements of resilient rollers or other stripping devices or members which may be selectively actuated to engage and separate a sheet upon passage of a stack through an intersection. This configuration may have advantages in other embodiments where greater speed in sheet separation is desired.

As will be appreciated from the foregoing discussion, in some banking machines it may be desirable to process certain sheets individually. For example, if it is determined that a sheet separated from a stack is a check or other negotiable instrument that must be transferred to the imaging device, it may be desirable to clear a path which enables the sheet requiring such handling to be transported individually. This can be accomplished by disposing the stack of sheets that are not currently being processed individually away from the single sheet in first path 46. In this manner the sheet requiring individual handling can be transferred to path 150 or such other location as may be necessary without causing the remaining stack to undergo transport to an undesirable location.

Figure 19:
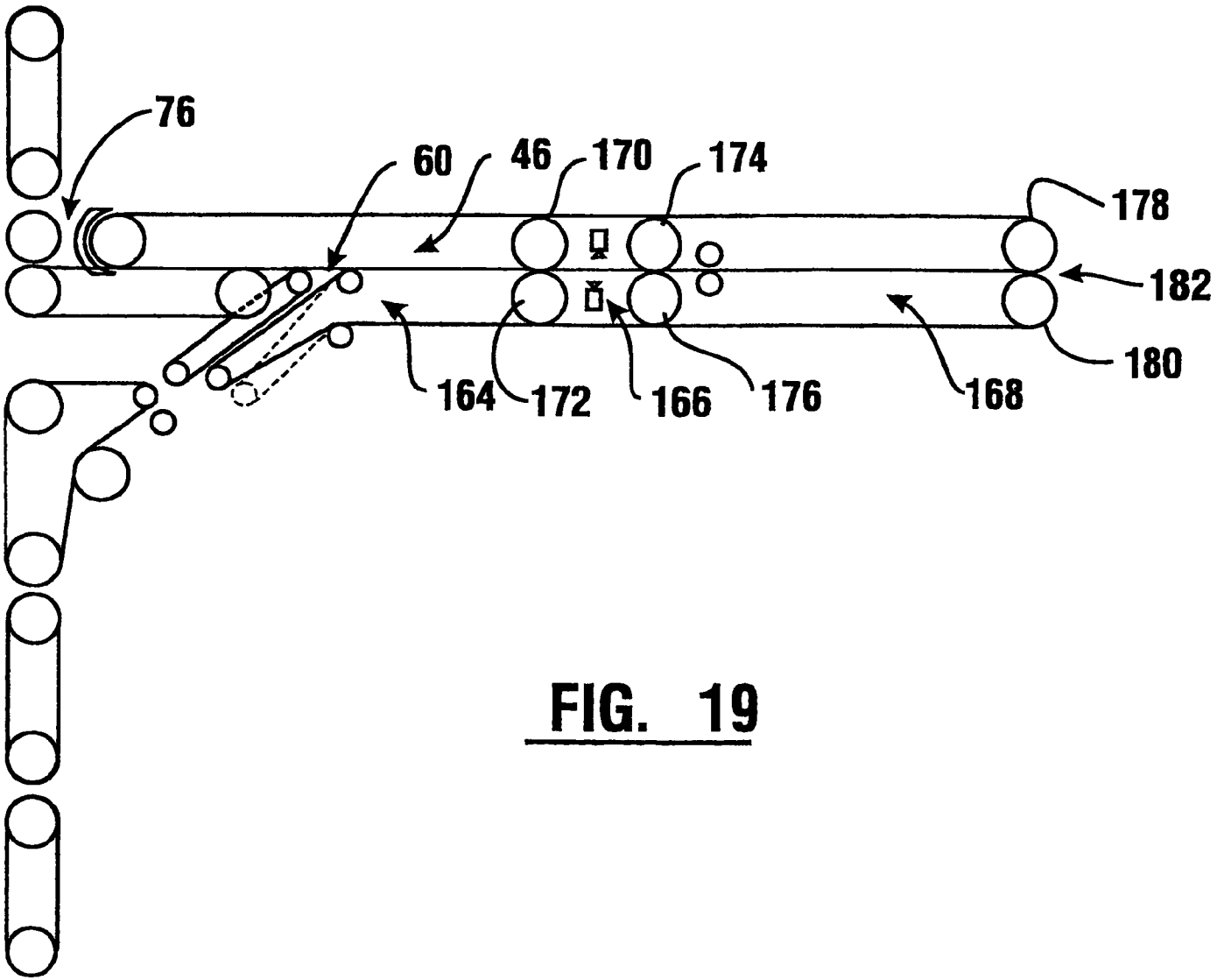
FIG. 19 is a schematic view of an alternative embodiment of the first, second and third transport paths with additional holding devices in the first transport path.

A further alternative to facilitate individual handling of particular sheets is represented by the alternative embodiment shown in FIG. 19. In this embodiment path 46 includes three separately controlled transport sections 164, 166 and 168. Transport section 164 is similar to the transport previously discussed, except that its belts terminate at rolls 170 and 172. Transport section 166 may include an interwoven belt transport similar to that shown in FIG. 5 with the exception that its belts are offset from those in transport section 164. Transport section 166 may be driven by one or more independent reversible drives from transport section 164. The drive for transport section 166 is in operative connection with and operates under the control of the control circuitry.

Transport section 166 terminates in rolls 174 and 176. Rolls 174 and 176 are coaxial with other rolls that are spaced intermediate thereto that are part of transport section 168. Transport section 168 terminates at rolls 178 and 180 which are adjacent to a customer accessible opening indicated 182. Transport section 168 is operated by at least one independent reversible drive in response to the control circuitry.

Transport sections 166 and 168 along path 46 provide locations in which documents or stacks of documents may be temporarily stored as other documents are routed through intersections 60 and 76. After the necessary processing is done on the individual documents, the documents that are temporarily stored in the transport sections 166 and 168 may be moved to other transport sections for further processing. It should be understood that transport sections 166 and 168 include appropriate sensors for sensing the positions of the documents being temporarily stored therein which enables the control circuitry to coordinate movement thereof.

Figure 17:
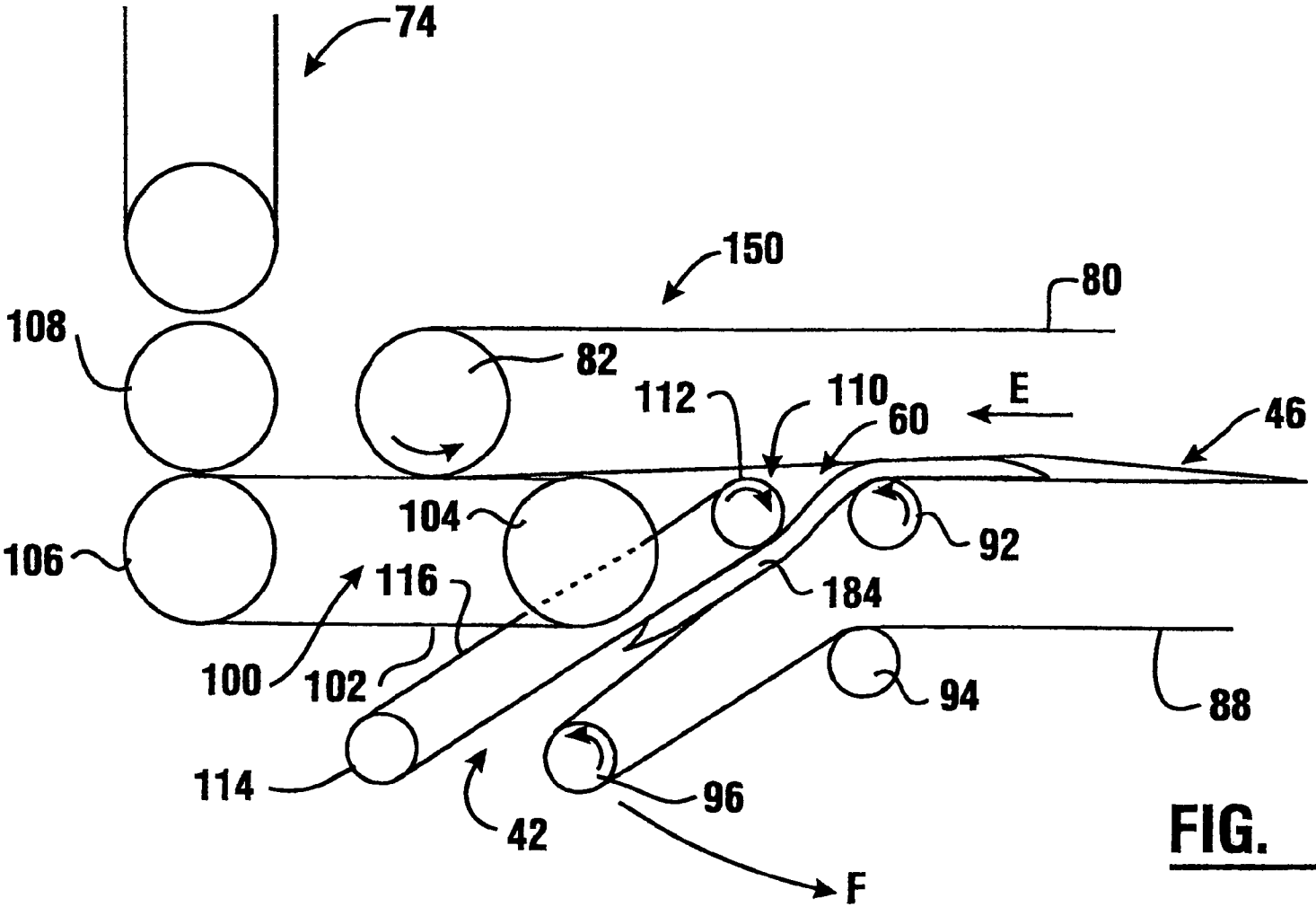
FIG. 17 is a schematic view of the first and second transport paths with a deposit envelope passing therethrough.

A further advantage of the exemplary embodiment described herein is that not only may the automated banking machine 10 accept individual documents and stacks of documents from a customer, but it may also accept conventional deposit envelopes. As shown in FIG. 17 a thick sheet like deposit envelope 184 may be moved along path 46 from a customer. The identification of the deposited item as a deposit envelope may be made based on readings from sensors 126, 128 or 130 as shown in FIG. 4, or alternatively or in addition based on customer inputs through one or more input devices at the customer interface 12 of the machine.

Deposit envelope 184 moves in transport path 46 in the direction of Arrow E as shown in FIG. 17. Upon determining that the item moving in the transport path is a deposit envelope, the control circuitry operates the sheet directing apparatus 110 to direct the envelope into transport path 42. The control circuitry also enables roll 96 and belts 88 to move in the direction indicated by Arrow F. This causes the flight of belt 88 to move to the position shown in phantom in FIG. 4. This enables the envelope to move into the depository device 40 (see FIG. 3) in which it may be stacked in aligned relation with other envelopes. Further the control circuitry may also operate transport 118 and rolls 124 shown in FIG. 4 to assure that envelope 184 does not pass further along sheet transport path 42 than the depository 40.

The ability of the embodiment of the automated banking machine to handle depository envelopes, stacks of sheets and individual sheets, provides enhanced functionality for the machine. The ability of the exemplary embodiment to accept thick items in the area of path 42 adjacent to the intersection, also enables the control circuitry to use the area adjacent to the intersection as a temporary storage location for stacks of sheets. This may be desirable in some embodiments where a receipt form is delivered on transport path 74 and must be directed to transport path 150 for printing thereon before being combined with a stack to be delivered to a customer.

The exemplary embodiment of the ATM has the capability of storing the assembled stack of sheets adjacent to intersection 60 in transport path 42 until such time as the printed receipt is moved into the intersection along first path 46. As the receipt form is produced by a document producing device and moved into the intersection 60 by transport section 100, the stack is moved into the intersection in coordinated relation therewith so that the printed receipt is assembled into the stack and positioned at the top side of the stack. The assembled stack may be moved along transport path 46 to the opening where it may be taken by the customer.

In some embodiments the ATM may also operate to provide certain types of documents in exchange for other documents. As previously discussed, some embodiments may receive checks or other instruments, validate the check, and provide the user with currency notes. In some embodiments, a user may provide notes to the ATM and receive other types of documents such as money orders, scrip, vouchers, gift certificates or bank checks. In some embodiments the control circuitry may operate in the manner previously discussed to store information concerning individual notes in a data store in correlated relation with information usable to identify the user who deposited the notes in the machine. Some embodiments may store in correlated relation with all or a portion of such data, information which identifies the check, money order or other document provided by the machine to the user.

In some embodiments, the ability of a single user to provide cash to the ATM may be controlled or limited to avoid money laundering or other suspect activities. For example, a user placing notes in the ATM to purchase money orders or other documents, may be required to provide at least one identifying input. This may include a biometric input such as a thumbprint for example. Such at least one identifying input may include data on a card or other device a user provides to operate the machine, or may be in lieu thereof or in addition thereto. Alternatively, some embodiments may enable use of the ATM to buy documents such as money orders, gift certificates or other documents without using a card or similar device to access the machine. In some cases a user may exchange notes of certain denominations for notes of other denominations. In such cases the control circuitry may require at least one identifying input from the user requesting to exchange cash for other documents.

The control circuitry can operate in accordance with programmed instructions and parameters to limit the number or value of documents a user may purchase or otherwise receive. This may include comparing user identifying data with data input in connection with prior transactions. This may be done by comparing user input data stored in a data store at the particular ATM, and/or data stored in computers connected to the ATM. By limiting the number or value of documents a user can purchase with cash, either overall, for a particular document or within a given time period, the risk of illegal activities such as money laundering can be minimized. Further such systems may more readily enable funds to be tracked.

Figure 22:
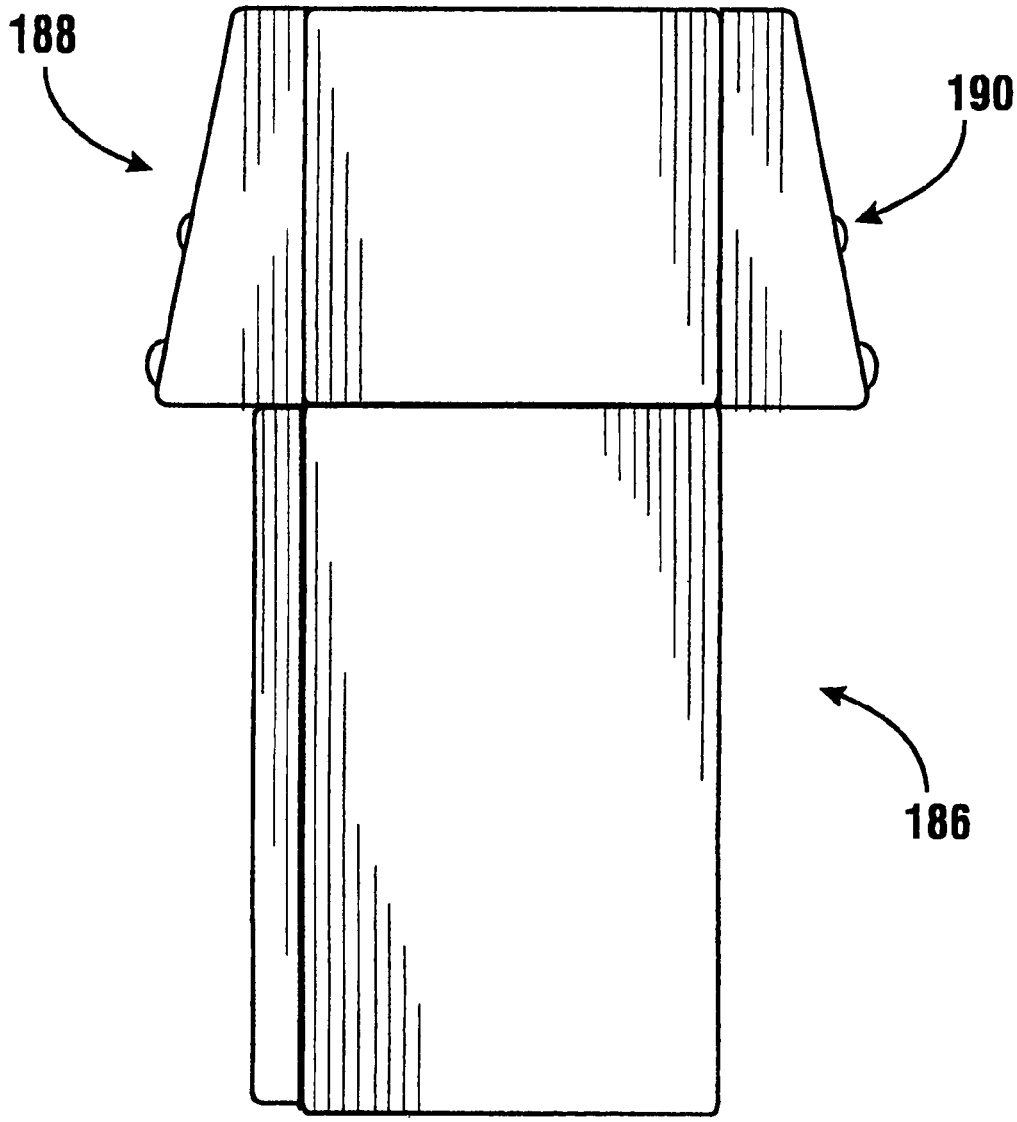
FIG. 22 is a side view of an automated banking machine housing the transport apparatus schematically shown in FIG. 21.

An alternative embodiment of an automated banking machine is indicated 186 in FIG. 22. Machine 186 is similar to machine 10 except that it includes two fascias and customer interfaces designated 188 and 190. Machine 186 is capable of operation by two users generally simultaneously.

Figure 21:
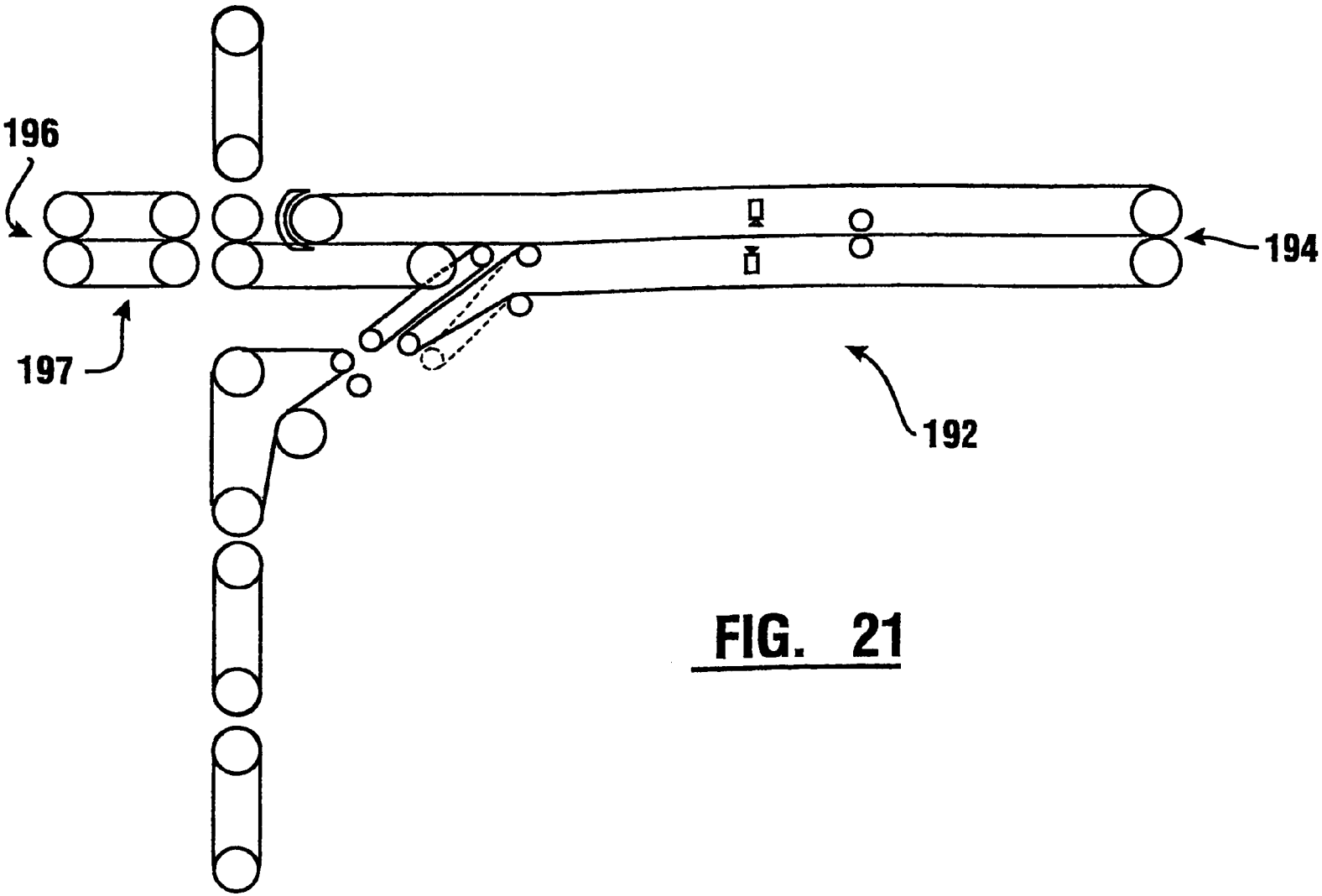
FIG. 21 is a schematic view of an alternative embodiment of the first, second and third transport paths used in an alternative automated banking machine in which two user interfaces and user accessible openings are provided.

The sheet handling mechanism for machine 186 is indicated 192 in FIG. 21. The sheet handling mechanism 192 is similar to that described in the first embodiment, except as otherwise noted. Mechanism 192 includes a first customer accessible opening 194 in customer interface 190, and a second customer accessible opening 196 in customer interface 188. Customer opening 196 receives and delivers sheets through a transport section 197. Transport section 197 is preferably an interwoven belt type transport of the type shown in FIG. 5 and is capable of moving sheets, envelopes and stacks of sheets in engagement therewith. Transport section 197 is operated by a reversible drive similar to the reversible drives used for the other belt transport sections, and is in operative connection with the control circuitry of the machine.

The operation of the alternative sheet handling mechanism 192 is similar to that previously described except that the sheets, envelopes or stacks of sheets that are processed may be received from or delivered to either customer opening 194 or customer opening 196. Because of the high speed capability of the exemplary embodiment, it is possible for the sheet handling mechanism 192 to adequately service two users simultaneously without undue delay.

As will be appreciated from the foregoing description, the modifications necessary for the sheet handling mechanism of the first embodiment to accommodate two simultaneous users is relatively modest. In the exemplary embodiment it is possible to increase the number of customer interfaces on the machine from one to two at a relatively small cost. This is particularly advantageous for an automated teller machine positioned in a high customer traffic area. It is also useful for automated banking machines, such as those used by tellers to count and dispense currency notes. This is because the configuration of the sheet handling mechanism enables two tellers or other personnel to be serviced by a single machine.

Exemplary embodiments may operate to assure operation in accordance with the principles of U.S. Pat. No. 6,315,194, the disclosure of which is incorporated herein by reference as if fully rewritten herein.

Thus the automated banking machine of the exemplary embodiment of the present invention achieves at least some of the above stated objectives, eliminates difficulties encountered in the use of prior devices and systems, solves problems and attains the desirable results described herein.

In the foregoing description certain terms have been used for brevity, clarity and understanding. However, no unnecessary limitations are to be implied therefrom because such terms are used for descriptive purposes and are intended to be broadly construed. Moreover the descriptions and illustrations given are by way of examples and the invention is not limited to the exact details shown or described.

In the following claims any feature described as a means for performing a function shall be construed as encompassing any means capable of performing the recited function, and not mere equivalents of the particular means described in the foregoing description. The inclusion of an Abstract shall not be deemed to limit the claimed invention to the features described in such Abstract.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

We claim:

1. Apparatus comprising:

an automated banking machine, wherein the automated banking machine is operative to receive at least one currency note therein, at least one data store in association with the machine, a currency note validation arrangement in association with the machine, wherein the validation arrangement is operative to assess the at least one currency note for validity, wherein the validation arrangement, responsive to assessing at least one currency note of suspect validity, is operative to cause storage in the at least one data store of data usable to uniquely identify the at least one currency note of suspect validity and a person associated with the at least one suspect currency note.

2. The apparatus according to claim 1 wherein the automated banking machine includes at least one currency note inlet, wherein the automated banking machine is operative to receive the at least one currency note from the person via the at least one currency note inlet.

3. The apparatus according to claim 2 wherein the automated banking machine includes at least one suspect note storage location, wherein the automated banking machine is operative to store at least one currency note in the suspect note storage location.

4. The apparatus according to claim 2 wherein the validation arrangement, responsive to a suspect currency note, is operative to cause storage of data usable to uniquely identify the suspect currency note and the person from whom the automated banking machine received the suspect currency note.

5. The apparatus according to claim 4 and further comprising at least one suspect currency note, wherein the validation arrangement includes at least one computer, wherein the at least one computer is operative to cause storage of data capable of uniquely identifying the at least one suspect currency note in correlation with the person.

6. The apparatus according to claim 5 wherein at least one suspect currency note comprises a counterfeit currency note, wherein the at least one computer is operative to cause storage of data capable of uniquely identifying the counterfeit currency note in correlation with the person.

7. The apparatus according to claim 1 wherein the validation arrangement is operative to determine a serial number of the at least one currency note, and wherein the validation arrangement is further operative to cause storage of data corresponding to the serial number.

8. The apparatus according to claim 7 wherein the validation arrangement is operative to compare the serial number to data corresponding to at least one serial number previously stored in the data store.

9. The apparatus according to claim 8 wherein the at least one serial number previously stored comprises serial numbers of counterfeit notes.

10. The apparatus according to claim 8 wherein the at least one serial number previously stored comprises serial numbers of notes already stored in the machine.

11. The apparatus according to claim 1 wherein the automated banking machine includes the validation arrangement, and wherein the validation arrangement includes at least one computer.

12. The apparatus according to claim 1 wherein the validation arrangement is operative to cause storing in correlated relation data usable to identify the at least one suspect currency note and data usable to identify the person.

13. The apparatus according to claim 1 wherein the automated banking machine includes at least one input device, wherein the automated banking machine is operative to receive at least one input from a person through the at least one input device, and wherein the data usable to identify the person corresponds to the at least one input.

14. The method according to claim 13 wherein data usable to identify the person corresponds to data received in at least one of an account number input and a biometric input, wherein the validation arrangement is operative to cause storage of data corresponding to at least one of an account number and biometric data.

15. The apparatus according to claim 1 wherein the automated banking machine is operative to provide to the person at least one non-cash document redeemable for value in exchange for the at least one currency note.

16. The apparatus according to claim 15 wherein the automated banking machine is operative to prevent providing the person non-cash documents in excess of a predetermined number or value.

17. The apparatus according to claim 15 wherein the validation arrangement includes at least one computer, wherein the at least one computer is operative to cause the storing in the data store of data usable to identify the at least one non-cash document redeemable for value in correlated relation with the data usable to identify the person.

18. The apparatus according to claim 15 wherein the at least one non-cash document redeemable for value comprises at least one of a money order, a gift certificate, and a financial check.

19. Apparatus comprising:

an automated banking machine, wherein the automated banking machine is operative to receive at least one note therein, at least one data store, a validation arrangement, wherein the validation arrangement includes at least one computer, wherein the validation arrangement is operative to assess the at least one note for validity, wherein the validation arrangement is operative to determine a serial number of the at least one note, wherein the validation arrangement is operative to cause a comparison of the serial number of the at least one note to data corresponding to at least one serial number previously stored in the data store, wherein the at least one computer is operative to cause storage in the at least one data store of data usable to identify the serial number of the at least one note and a machine user from whom the at least one note was received.

20. Apparatus comprising:

an automated banking machine, wherein the automated banking machine is operative to receive at least one note therein, wherein the automated banking machine includes at least one input device, wherein the automated banking machine is operative to receive at least one input from a machine user via the at least one input device, wherein the automated banking machine is operative to receive a user request for at least one non-cash document redeemable for value in exchange for the at least one note, wherein the automated banking machine is operative to provide the at least one non-cash document from the machine, at least one data store, a note validation arrangement, wherein the validation arrangement includes at least one computer, wherein the validation arrangement is operative to assess the at least one note for validity, wherein the at least one computer is operative to cause storage in the at least one data store of data usable to identify the at least one note and a user from whom the at least one note was received, wherein the data usable to identify the user corresponds to the at least one input.

* * * * *